US008745972B2

(12) United States Patent
Yoshida et al.

(10) Patent No.: US 8,745,972 B2
(45) Date of Patent: Jun. 10, 2014

(54) EXHAUST PURIFICATION SYSTEM OF INTERNAL COMBUSTION ENGINE

(75) Inventors: Kohei Yoshida, Gotenba (JP); Takamitsu Asanuma, Mishima (JP); Masahide Iida, Susono (JP); Yuichi Sobue, Susono (JP)

(73) Assignee: Toyota Jidosha Kabushiki Kaisha, Toyota-shi (JP)

( * ) Notice: Subject to any disclaimer, the term of this patent is extended or adjusted under 35 U.S.C. 154(b) by 139 days.

(21) Appl. No.: 13/318,992

(22) PCT Filed: May 7, 2009

(86) PCT No.: PCT/JP2009/058951

§ 371 (c)(1), (2), (4) Date: Nov. 4, 2011

(87) PCT Pub. No.: WO2010/128562

PCT Pub. Date: Nov. 11, 2010

(65) Prior Publication Data

US 2012/0047878 A1 Mar. 1, 2012

(51) Int. Cl.
*F01N 3/00* (2006.01)

(52) U.S. Cl.
USPC ..... 60/297; 60/274; 60/286; 60/301

(58) Field of Classification Search
USPC ..... 60/274, 286, 295, 297, 301
See application file for complete search history.

(56) References Cited

U.S. PATENT DOCUMENTS 6,199,372 B1 * 3/2001 Wakamoto ..... 60/274
6,272,848 B1 * 8/2001 Okude et al. ..... 60/274
6,644,021 B2 * 11/2003 Okada et al. ..... 60/286
7,121,086 B2 10/2006 Nishii et al.
7,669,410 B2 * 3/2010 Nagaoka et al. ..... 60/286
7,707,826 B2 * 5/2010 Wang et al. ..... 60/295
8,104,271 B2 * 1/2012 Yoshida et al. ..... 60/295
8,322,131 B2 * 12/2012 Yamamoto ..... 60/286

FOREIGN PATENT DOCUMENTS

JP 2000 314311 11/2000
JP 2002 256858 9/2002
JP 2002 364349 12/2002
JP 2007 303306 11/2007

OTHER PUBLICATIONS

International Search Report Issued Jul. 21, 2009 in PCT/JP09/058951 Filed May 7, 2009.

* cited by examiner

*Primary Examiner* — Binh Q Tran
(74) *Attorney, Agent, or Firm* — Oblon, Spivak, McClelland, Maier & Neustadt, L.L.P.

(57) ABSTRACT

An exhaust purification system of an internal combustion engine includes an $NO_X$ storage reduction catalyst device which is arranged in an engine exhaust passage. The $NO_X$ storage reduction catalyst device stores $SO_X$ simultaneously with $NO_X$. When the stored $SO_X$ amount exceeds a predetermined allowable amount, the $SO_X$ is made to be released by $SO_X$ release control which raises the temperature of the $NO_X$ catalyst device to the $SO_X$ releasable temperature, then makes the air-fuel ratio of the exhaust gas which flows into the $NO_X$ catalyst device the stoichiometric air-fuel ratio or rich. The $NO_X$ catalyst device has a residual $SO_X$ storage amount which finally remains even if performing $SO_X$ release control depending on the temperature of the $NO_X$ catalyst device when performing $SO_X$ release control. The system uses the residual $SO_X$ storage amount of the current $SO_X$ release control as the basis to calculate the $SO_X$ release speed at each timing in the current $SO_X$ release control.

9 Claims, 12 Drawing Sheets

EXHAUST PURIFICATION SYSTEM OF INTERNAL COMBUSTION ENGINE

TECHNICAL FIELD

The present invention relates to an exhaust purification system of an internal combustion engine.

BACKGROUND ART

The exhaust gas of diesel engines, gasoline engines, and other internal combustion engines includes, for example, carbon monoxide (CO), unburned fuel (HC), nitrogen oxides ($NO_X$), particulate matter (PM), and other constituents. The internal combustion engines are mounted with exhaust purification systems for removing these constituents.

As one method for removing nitrogen oxides, arrangement of an $NO_X$ storage reduction catalyst in an engine exhaust passage has been proposed. The $NO_X$ storage reduction catalyst stores $NO_X$ when the air-fuel ratio of the exhaust gas is lean. When the storage amount of the $NO_X$ reaches an allowable amount, the air-fuel ratio of the exhaust gas may be made rich or the stoichiometric air-fuel ratio so that the stored $NO_X$ is released. The released $NO_X$ is reduced to $N_2$ by the carbon monoxide or other reducing agent which is contained in the exhaust gas.

Japanese Patent Publication (A) No. 2000-314311 discloses a purification system arranging a purification catalyst of nitrogen oxides in an exhaust gas flow path of the internal combustion engine. The nitrogen oxide purification catalyst has a precious metal and a nitrogen oxide trapping material. It is disclosed that the nitrogen oxide purification catalyst can trap nitrogen oxides as $NO_2$ by a higher air-fuel ratio than the stoichiometric air-fuel ratio. Further, the trapping material of nitrogen oxides traps $SO_X$, but it is disclosed that by rendering the atmosphere a reducing one, the trapped $SO_X$ can be removed. Further, it is disclosed that the temperature for removing the trapped $SO_X$ is preferably 500° C. or more.

The exhaust gas of an internal combustion engine sometimes contains sulfur oxides ($SO_X$). An $NO_X$ storage reduction catalyst stores $SO_X$ at the same time as storing $NO_X$. If $SO_X$ is stored, the storable amount of $NO_X$ falls. In this way, the $NO_X$ storage reduction catalyst suffers from so-called "sulfur poisoning". To eliminate sulfur poisoning, sulfur poisoning recovery treatment is performed for releasing the $SO_X$. In the sulfur poisoning recovery treatment, the $NO_X$ storage reduction catalyst is raised in temperature and, in that state, the air-fuel ratio of the exhaust gas is made rich or the stoichiometric air-fuel ratio to release the $SO_X$.

At the time of sulfur poisoning recovery treatment of the $NO_X$ storage reduction catalyst, the $SO_X$ is released into the atmosphere. If the release speed of the $SO_X$ is large, a large amount of $SO_X$ ends up being released in a short time, so odor and other problems arise.

On the other hand, an $NO_X$ storage reduction catalyst suffers from thermal degradation. If thermal degradation occurs, for example, the $NO_X$ storable amount is decreased. Thermal degradation proceeds faster the higher the temperature of the $NO_X$ storage reduction catalyst. When performing sulfur poisoning recovery treatment, the temperature elevated state continues for a long time. For this reason, at the time of sulfur poisoning recovery treatment, thermal degradation proceeds relatively fast.

In the prior art, the target temperature and the regeneration time of the $NO_X$ storage reduction catalyst are set in advance. During this regeneration time, the sulfur poisoning recovery treatment was performed while maintaining the target temperature. Alternatively, the $SO_X$ release speed may be detected by using a map using the fuel injection amount and temperature etc. in the combustion chambers as functions. The $SO_X$ release amount can be calculated from the $SO_X$ release speed. However, the $SO_X$ release speed which is detected by the prior art includes relatively large error. For this reason, at the time of sulfur poisoning recovery treatment, there was a possibility that the $NO_X$ storage reduction catalyst would be exposed to a higher temperature atmosphere than required and that thermal degradation would excessively proceed. The $SO_X$ release speed when performing sulfur poisoning recovery treatment preferably can be precisely detected.

DISCLOSURE OF INVENTION

The present invention has as its object the provision of an exhaust purification system of an internal combustion engine including an $NO_X$ storage reduction catalyst device, which exhaust purification system of an internal combustion engine can precisely calculate an $SO_X$ release speed when performing sulfur poisoning recovery treatment.

The exhaust purification system of an internal combustion engine of the present invention arranges in an engine exhaust passage an $NO_X$ catalyst device which stores $NO_X$ which is contained in exhaust gas when an air-fuel ratio of the inflowing exhaust gas is lean and which releases the stored $NO_X$ when the air-fuel ratio of the inflowing exhaust gas becomes a stoichiometric air-fuel ratio or rich and which uses $SO_X$ release control which raises a temperature of the $NO_X$ catalyst device to an $SO_X$ releasable temperature when an $SO_X$ amount which is stored in the $NO_X$ catalyst device exceeds a predetermined allowable amount and which makes the air-fuel ratio of the exhaust gas which flows into the $NO_X$ catalyst device a stoichiometric air-fuel ratio or rich so as to make the stored $SO_X$ be released. The $NO_X$ catalyst device has a residual $SO_X$ storage amount which is dependent on the temperature of the $NO_X$ catalyst device when performing $SO_X$ release control and finally remains even if performing $SO_X$ release control. The system uses the residual $SO_X$ storage amount of the current $SO_X$ release control as the basis to calculate the $SO_X$ release speed at each timing in the current $SO_X$ release control. By adopting this configuration, the system precisely calculate the $SO_X$ release speed when performing $SO_X$ release control.

In the above invention, preferably, in the current $SO_X$ release control, the system uses a difference between a $SO_X$ storage amount at each timing and the residual $SO_X$ storage amount as the basis to calculate the $SO_X$ release speed at each timing.

In the above invention, preferably the system uses the $SO_X$ release speed which was calculated at each timing of the $SO_X$ release control as the basis to calculate a cumulative $SO_X$ release amount which is released from the start of $SO_X$ release control to the current timing and corrects the calculated $SO_X$ release speed at the current timing based on a ratio of a first radius and a second radius where when a releasable $SO_X$ amount obtained by subtracting from an $SO_X$ storage amount when starting $SO_X$ release control the residual $SO_X$ storage amount is deemed to correspond to an area of a circle of the first radius, a radius of a circle of an area corresponding to the cumulative $SO_X$ release amount is calculated as the second radius.

In the above invention, preferably the $NO_X$ catalyst device has a final $NO_X$ storable amount at which $NO_X$ can be stored when the residual $SO_X$ storage amount remains, and the system uses the $SO_X$ release speed which was calculated at each timing of the $SO_X$ release control as the basis to calculate an $NO_X$ recovery amount which is restored from the start of $SO_X$ release control to the current timing and corrects the calculated $SO_X$ release speed at the current timing based on a ratio of a first radius and a second radius where when a restorable $NO_X$ storable amount obtained by subtracting from the final $NO_X$ storable amount an $NO_X$ storable amount when starting $SO_X$ release control is deemed to correspond to an area of a circle of the first radius, a radius of a circle of an area corresponding to the $NO_X$ recovery amount is calculated as the second radius.

In the above invention, preferably the system uses the $SO_X$ release speed which was calculated at each timing of the $SO_X$ release control as the basis to calculate a cumulative $SO_X$ release amount which is released from the start of $SO_X$ release control to the current timing and corrects the calculated $SO_X$ release speed at the current timing based on a ratio of a first radius and a second radius where when a releasable $SO_X$ amount obtained by subtracting from an $SO_X$ storage amount when starting $SO_X$ release control the residual $SO_X$ storage amount is deemed to correspond to a volume of a sphere of the first radius, a radius of a sphere of a volume corresponding to the cumulative $SO_X$ release amount is calculated as the second radius.

In the above invention, preferably the $NO_X$ catalyst device has a final $NO_X$ storable amount at which storage of $NO_X$ is possible when the residual $SO_X$ storage amount remains, and the system uses an $SO_X$ release speed which was calculated at the each timing of $SO_X$ release control as the basis to calculate a $NO_X$ recovery amount which is restored from the start of $SO_X$ release control to the current timing and corrects the calculated $SO_X$ release speed at the current timing based on a ratio of a first radius and a second radius where when a restorable $NO_X$ storable amount obtained by subtracting from the final $NO_X$ storable amount an $NO_X$ storable amount when starting $SO_X$ release control is deemed to correspond to a volume of a sphere of the first radius, a radius of a sphere of a volume corresponding to the $NO_X$ recovery amount is calculated as the second radius.

BEST MODE FOR CARRYING OUT INVENTION

Embodiment 1

Referring to FIG. 1 to FIG. 10, an exhaust purification system of an internal combustion engine in Embodiment 1 will be explained. The internal combustion engine in the present embodiment is arranged in a vehicle. In the present embodiment, the explanation will be given with reference to a compression ignition type diesel engine mounted in a vehicle as an example.

Figure 1:
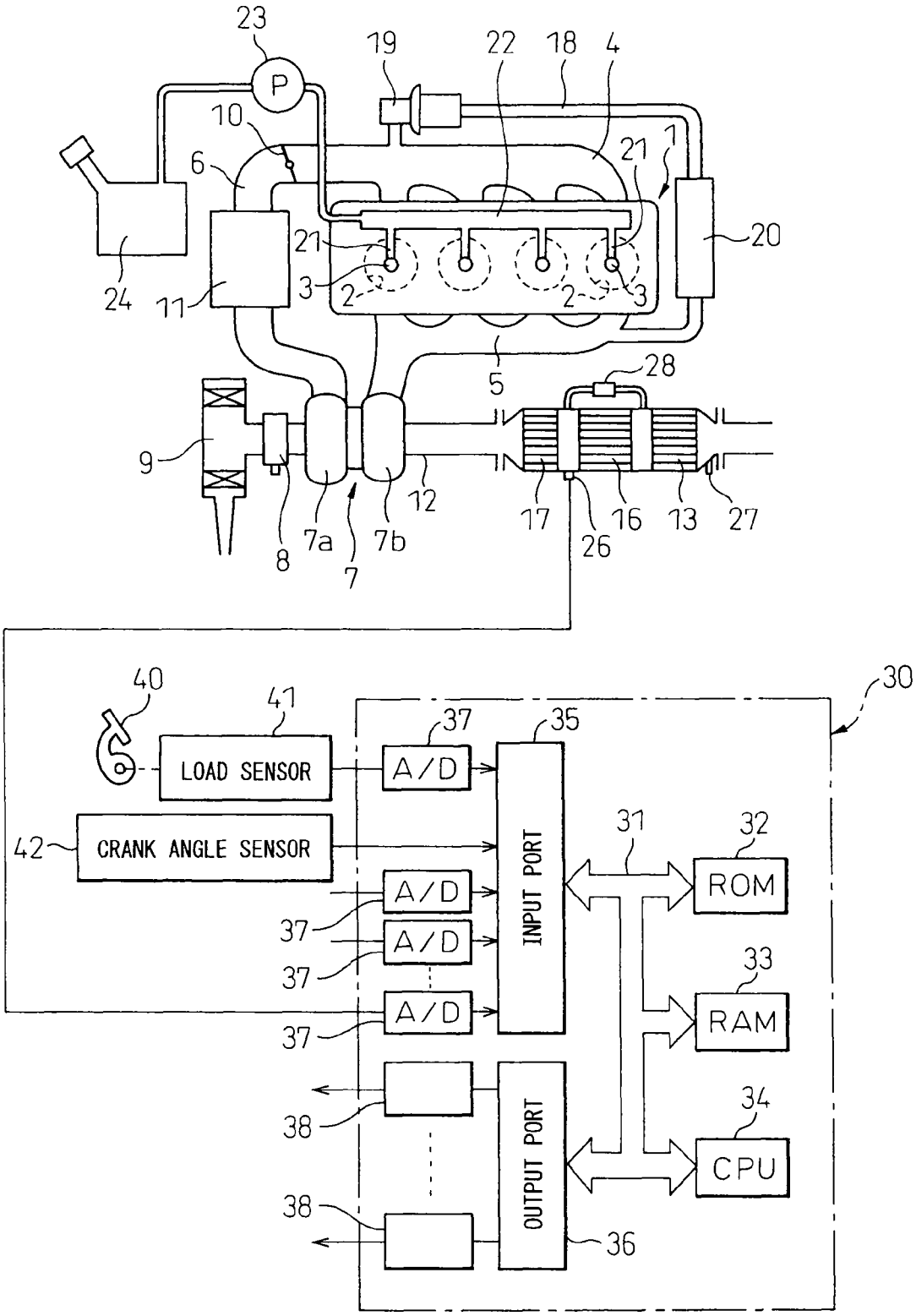
FIG. 1 is a schematic view of an internal combustion engine in Embodiment 1.

FIG. 1 shows an overall view of the internal combustion engine in the present embodiment. The internal combustion engine is provided with an engine body 1. Further, the internal combustion engine is provided with an exhaust purification system which purifies exhaust gas. The engine body 1 includes cylinders constituted by combustion chambers 2, electronic control type fuel injectors 3 for injecting fuel into the combustion chambers 2, an intake manifold 4, and an exhaust manifold 5.

The intake manifold 4 is connected through an intake duct 6 to an outlet of a compressor 7*a* of an exhaust turbocharger 7. An inlet of the compressor 7*a* is connected through an intake air detector 8 to an air cleaner 9. Inside the intake duct 6, a throttle valve 10 which is driven by a step motor is arranged. Furthermore, around the intake duct 6, a cooling device 11 is arranged for cooling the intake air which flows through the inside of the intake duct 6. In the embodiment shown in FIG. 1, the engine cooling water is guided to the cooling device 11. The engine cooling water is used to cool the intake air.

The exhaust manifold 5 is connected to the inlet of an exhaust turbine 7*b* of the exhaust turbocharger 7. The exhaust purification system in the present embodiment is provided with an $NO_X$ catalyst device comprised of an $NO_X$ storage reduction catalyst device (NSR) 17 (hereinafter simply referred to as an "$NO_X$ storage reduction catalyst"). The $NO_X$ storage reduction catalyst 17 is connected to an outlet of the exhaust turbine 7*b* through an exhaust pipe 12. Downstream of the $NO_X$ storage reduction catalyst 17 inside of the engine exhaust passage, a particulate filter 16 is arranged for trapping particulate in the exhaust gas. Further, downstream of the particulate filter 16 inside of the engine exhaust passage, an oxidation catalyst 13 is arranged.

Between the exhaust manifold 5 and the intake manifold 4, an EGR passage 18 is arranged for performing exhaust gas recirculation (EGR). Inside the EGR passage 18, an electronic control type EGR control valve 19 is arranged. Further, around the EGR passage 18, a cooling device 20 is arranged for cooling the EGR gas which flows through the inside of the EGR passage 18. In the embodiment shown in FIG. 1, engine cooling water is guided into the cooling device 20. The engine cooling water is used to cool the EGR gas.

The fuel injectors 3 are connected through fuel feed tubes 21 to a common rail 22. The common rail 22 is connected through an electronic control type variable discharge fuel pump 23 to a fuel tank 24. The fuel which is stored in the fuel tank 24 is supplied by a fuel pump 23 to the inside of the common rail 22. The fuel which is supplied to the inside of the common rail 22 is supplied through the fuel feed tubes 21 to the fuel injectors 3.

The electronic control unit 30 is comprised of a digital computer. The electronic control unit 30 in the present embodiment functions as a control system of the exhaust purification system. The electronic control unit 30 includes constituents which are connected to each other by a bidirectional bus 31 such as a ROM (read only memory) 32, RAM (random access memory) 33, CPU (microprocessor) 34, input port 35, and output port 36.

The ROM 32 is a read only storage device. The ROM 32 stores in advance maps and other information necessary for control. The CPU 34 can perform any computation or judgment. The RAM 33 is a random access storage device. The RAM 33 stores the operating history and other information or temporarily stores results of processing.

Downstream of the $NO_X$ storage reduction catalyst 17, a temperature sensor 26 is arranged for detecting the temperature of the $NO_X$ storage reduction catalyst 17. Downstream of the oxidation catalyst 13, a temperature sensor 27 is arranged for detecting the temperature of the oxidation catalyst 13 or particulate filter 16. At the particulate filter 16, a differential pressure sensor 28 is attached for detecting the differential pressure before and after the particulate filter 16. The output signals of these temperature sensors 26 and 27, differential pressure sensor 28, and intake air detector 8 are input through the corresponding AD converters 37 to the input port 35.

An accelerator pedal 40 is connected to a load sensor 41 which generates an output voltage proportional to the amount of depression of the accelerator pedal 40. The output voltage of the load sensor 41 is input through a corresponding AD converter 37 to the input port 35. Furthermore, the input port 35 is connected to a crank angle sensor 42 which generates an output pulse every time the crankshaft rotates by for example 15°. The output of the crank angle sensor 42 can be used to detect the speed of the engine body 1.

On the other hand, the output port 36 is connected through corresponding drive circuits 38 to the fuel injectors 3, the step motor for driving the throttle valve 10, the EGR control valve 19, and the fuel pump 23. In this way, the fuel injector 3 and throttle valve 10 etc. are controlled by the electronic control unit 30.

The oxidation catalyst 13 is a catalyst which has an oxidation ability. The oxidation catalyst 13 is, for example, provided with a substrate which has partition walls extending in the flow direction of the exhaust gas. The substrate is, for example, formed in a honeycomb structure. The substrate is for example housed in a tubular case. On the surface of the substrate, for example, a porous oxide powder is used to form a coated layer serving as a catalyst carrier. The coated layer carries a catalyst metal formed by platinum (Pt), rhodium (Rd), palladium (Pd), or other such precious metal. The carbon monoxide or unburned hydrocarbons which are contained in the exhaust gas are oxidized at the oxidation catalyst and converted to water, carbon dioxide, etc.

The particulate filter 16 is a filter for removing carbon particles, sulfates and other ion-based particles, and other particulates contained in the exhaust gas. The particulate filter, for example, has a honeycomb structure and has a plurality of channels extending in the flow direction of the gas. In the plurality of channels, channels with downstream ends which are sealed and channels with upstream ends which are sealed are alternately formed. The partition walls of the channels are formed by cordierite or other such porous material. When the exhaust gas passes through these partition walls, the particulate is trapped.

The particulate matter is trapped and oxidized on the particulate filter 16. The particulate matter which gradually deposits on the particulate filter 16 is removed by oxidation by raising the temperature in an excess air atmosphere to for example 600° C. or so.

Figure 2:
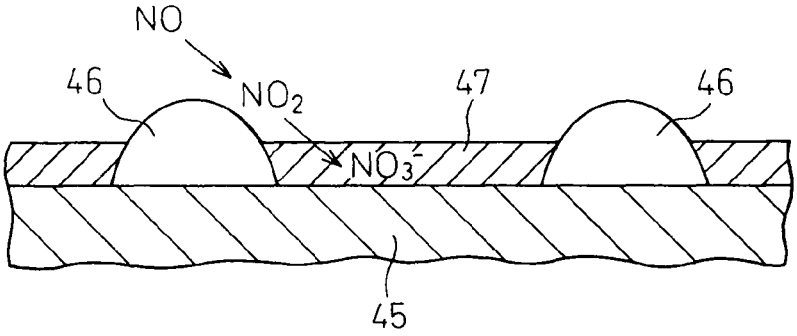
FIG. 2 is an enlarged schematic cross-sectional view of an $NO_X$ storage reduction catalyst device when storing $NO_X$.

FIG. 2 is an enlarged schematic cross-sectional view of an $NO_X$ storage reduction catalyst. The $NO_X$ storage reduction catalyst 17 is a catalyst which temporarily stores the $NO_X$ which is contained in the exhaust gas which is discharged from the engine body 1 and converts the stored $NO_X$ to $N_2$ when releasing it.

The $NO_X$ storage reduction catalyst 17 is comprised of a substrate on which for example a catalyst carrier 45 comprised of alumina is carried. On the surface of the catalyst carrier 45, a catalyst metal 46 formed by a precious metal is carried dispersed. On the surface of the catalyst carrier 45, a layer of an $NO_X$ absorbent 47 is formed. As the catalyst metal 46, for example, platinum Pt is used. As the ingredient forming the $NO_X$ absorbent 47, for example, at least one element selected from potassium K, sodium Na, cesium Cs, or other such alkali metal, barium Ba, calcium Ca, or other alkali earth, lanthanum La, yttrium Y, or other such rare earth is used. In the present embodiment, as the ingredient forming the $NO_X$ absorbent 47, barium Ba is used.

In the present invention, the ratio of the air and fuel (hydrocarbons) in the exhaust gas which is supplied to the engine intake passage, combustion chambers, or engine exhaust passage is referred to as the "air-fuel ratio of the exhaust gas (A/F)". When the air-fuel ratio of the exhaust gas is lean (when it is larger than the stoichiometric air-fuel ratio), the NO which is contained in the exhaust gas is oxidized on the catalyst metal 46 and becomes $NO_2$. The $NO_2$ is stored in the form of nitrate ions $NO_3^-$ in the $NO_X$ absorbent 47. As opposed to this, when the air-fuel ratio of the exhaust gas is rich or when it becomes the stoichiometric air-fuel ratio, the nitrate ions $NO_3^-$ which are stored in the $NO_X$ absorbent 47 are released in the form of $NO_2$ from the $NO_X$ absorbent 47. The released $NO_X$ is reduced to $N_2$ by the unburned hydrocarbons, carbon monoxide, etc. contained in the exhaust gas.

Figure 3:
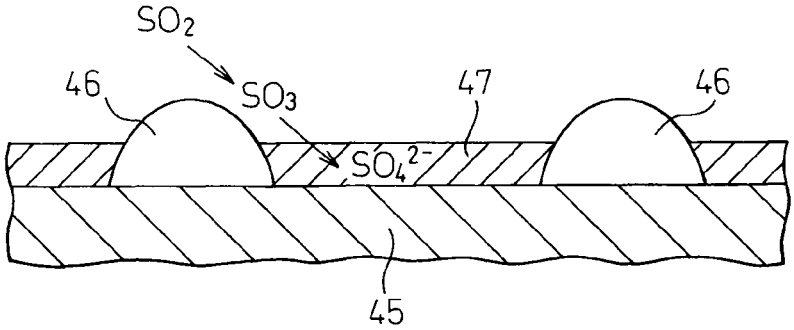
FIG. 3 is an enlarged cross-sectional view of an $NO_X$ storage reduction catalyst device when storing $SO_X$.

FIG. 3 shows another enlarged schematic cross-sectional view of an $NO_X$ storage reduction catalyst. Exhaust gas contains $SO_X$, that is, $SO_2$. If $SO_2$ flows into the $NO_X$ storage reduction catalyst 17, it is oxidized at the catalyst metal 46 and becomes $SO_3$. This $SO_3$ is absorbed at the $NO_X$ absorbent 47 and for example generates sulfate $BaSO_4$. Sulfate $BaSO_4$ is stable and hard to break down. If just making the air-fuel ratio of the exhaust gas rich, the sulfate $BaSO_4$ remains as it is without being broken down. For this reason, the $NO_X$ amount which the $NO_X$ storage reduction catalyst can store falls. In this way, the $NO_X$ storage reduction catalyst suffers from sulfur poisoning.

To recover from sulfur poisoning, the temperature of the $NO_X$ storage reduction catalyst is raised to a temperature where $SO_X$ can be released. In this state, $SO_X$ release control is performed to make the air-fuel ratio of the exhaust gas which flows into the $NO_X$ storage reduction catalyst rich or the stoichiometric air-fuel ratio. By performing this $SO_X$ release control, it is possible to make the $NO_X$ storage reduction catalyst release $SO_X$.

In the present embodiment, at the time of ordinary operation of the internal combustion engine, the $SO_X$ amount which is stored in the $NO_X$ storage reduction catalyst is calculated. The $SO_X$ storage amount is calculated continuously during operation of the internal combustion engine. The exhaust purification system in the present embodiment is provided with a detection device for the $SO_X$ storage amount during ordinary operation. Referring to FIG. 1, the detection device for the $SO_X$ storage amount in the present embodiment includes an electronic control unit 30.

Figure 4:
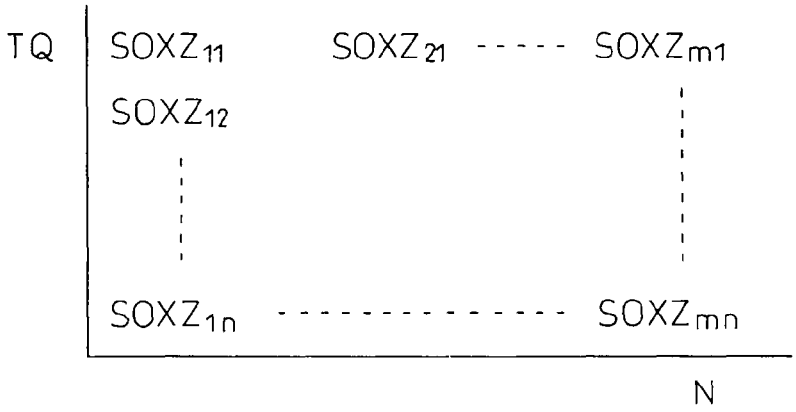
FIG. 4 is a map of an $SO_X$ storage amount per unit time as a function of the engine speed and the demanded torque.

FIG. 4 shows a map of the $SO_X$ amount which is stored per unit time in the $NO_X$ storage reduction catalyst as a function of the engine speed and the demanded torque. By specifying the engine speed N and the demanded torque TQ, it is possible to find the $SO_X$ amount SOXZ which is stored in the $NO_X$ storage reduction catalyst per unit time. This map is stored in for example the ROM 32 of the electronic control unit 30. The operation is continued and, every predetermined time period, the $SO_X$ amount which is stored per unit time is found from the map. The $SO_X$ storage amount is for example stored in the RAM 33. It is possible to consider the $SO_X$ storage amount which remains at the time of the end of the previous sulfur poisoning recovery treatment and cumulatively add the calculated $SO_X$ storage amount so as to detect the $SO_X$ storage amount at any timing.

The detection device of the $SO_X$ amount which is stored during ordinary operation is not limited to this mode. It is possible to employ any device which can detect the $SO_X$ amount which is stored in the $NO_X$ storage reduction catalyst.

Figure 5:
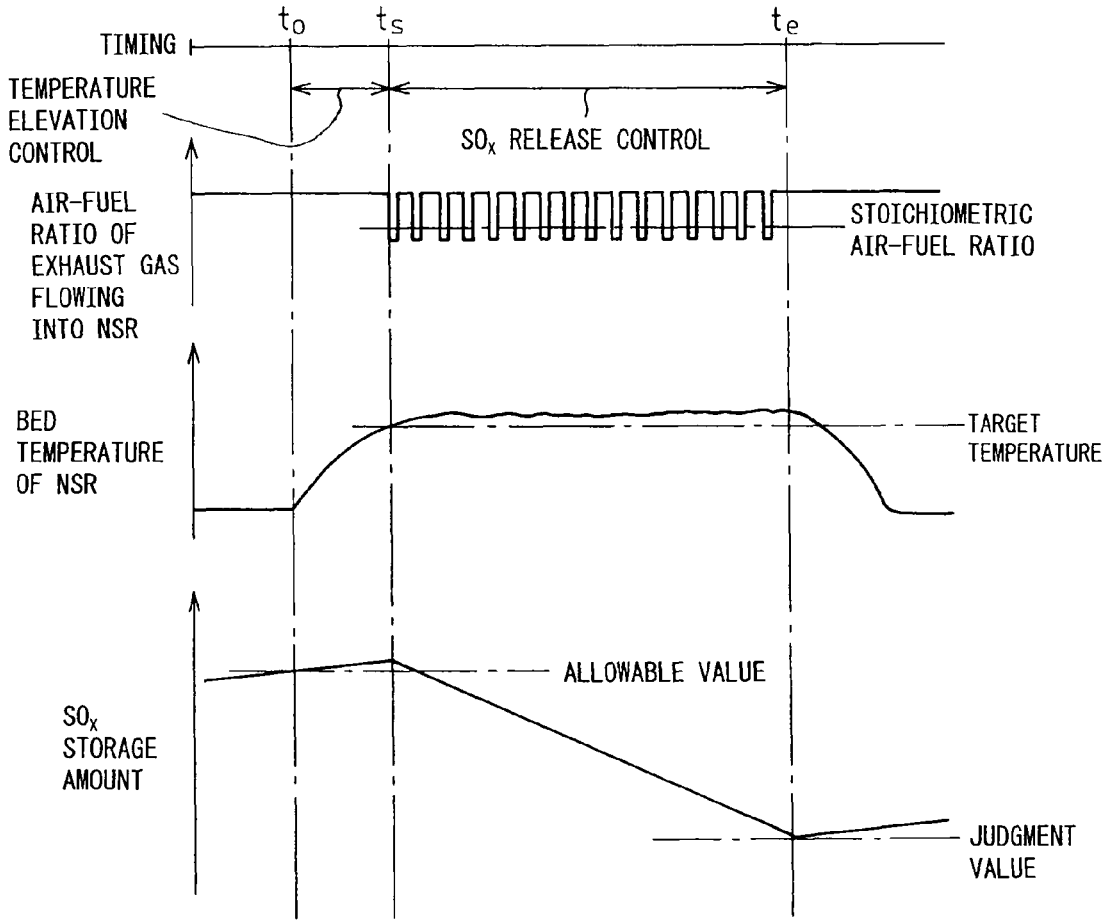
FIG. 5 is a time chart for when performing sulfur poisoning recovery treatment.

FIG. 5 shows a time chart for when performing sulfur poisoning recovery treatment. At the timing $t_0$, the $SO_X$ storage amount of the $NO_X$ storage reduction catalyst reaches the allowable value. From the timing $t_0$, the sulfur poisoning recovery treatment is started. Temperature elevation control is performed to raise the temperature of the $NO_X$ storage reduction catalyst from the timing $t_0$. Referring to FIG. 1, the temperature elevation control is, for example, performed by controlling the fuel injectors 3 which inject fuel into the combustion chambers 2. In the combustion chambers 2, it is possible to retard the injection timing of the main injection performed near compression top dead center so as to make the temperature of the exhaust gas rise. Furthermore, by performing after-injection as auxiliary injection at a time at which fuel can be burned after main injection, it is possible to make the temperature of the exhaust gas rise. By the temperature of the exhaust gas rising, the $NO_X$ storage reduction catalyst can be raised in temperature.

At the timing $t_s$ the bed temperature of the $NO_X$ storage reduction catalyst reaches the target temperature at which $SO_X$ can be released. $SO_X$ release control is performed from the timing $t_s$. In the $SO_X$ release control of the present embodiment, the bed temperature of the $NO_X$ storage reduction catalyst is maintained at a substantially constant temperature. Furthermore, in the $SO_X$ release control, the air-fuel ratio of the exhaust gas which flows into the $NO_X$ storage reduction catalyst is made the stoichiometric air-fuel ratio or rich.

In the present embodiment, the injection amount of the after injection is increased to make the air-fuel ratio of the exhaust gas the stoichiometric air-fuel ratio or rich. At this time, the throttle valve 10 which is arranged at the engine intake passage may also be choked. Alternatively, by performing post-injection as auxiliary injection at a time at which fuel cannot be burned after the main injection, the air-fuel ratio of the exhaust gas can be made the stoichiometric air-fuel ratio or rich. The "post-injection" is injection which is performed after the injection timing of the after-injection. By making the air-fuel ratio of the exhaust gas which flows into the $NO_X$ storage reduction catalyst the stoichiometric air-fuel ratio or rich, the $SO_X$ can be made to be released.

The device which raises the temperature of the $NO_X$ storage reduction catalyst and the device which controls the air-fuel ratio of the exhaust gas which flows into the $NO_X$ storage reduction catalyst are not limited to this mode. Any device may be employed.

At the timing $t_e$, the $SO_X$ storage amount reaches the judgment value for ending the $SO_X$ release control. At the timing $t_e$, the $SO_X$ release control is ended and the sulfur poisoning recovery treatment is ended.

When performing $SO_X$ release control, the speed by which $SO_X$ is released from the $NO_X$ storage reduction catalyst is expressed by the following formula. The $SO_X$ release speed R becomes a function of the temperature T, the $SO_X$ storage amount S of the current timing, and the reducing agent CO which flows into the $NO_X$ storage catalyst. The reducing agent includes unburned fuel and carbon monoxide.

$$R=f(T,S,CO) \tag{1}$$

The $SO_X$ release speed R can, for example, be specifically expressed by the following formula. The next formula applies the Arrhenius equation.

$$R=A\times\exp(-E_a/RT)\times[SO_X][CO] \tag{2}$$

Here, the coefficient A is a frequency factor and is a physical value. A can be found experimentally. The constant $E_a$ is the activation energy and is a known physical property. The variable T is the absolute temperature. The coefficient R is the gas constant. The variable $[SO_X]$ shows the concentration of sulfates. The variable [CO] shows the concentration of the reducing agent which flows into the $NO_X$ storage reduction catalyst.

Formula (2) shows that for example the higher the temperature, the greater the $SO_X$ release speed becomes and that the greater the $SO_X$ storage amount, the greater the $SO_X$ release speed becomes. Furthermore, this shows that the greater the amount of the reducing agent, the greater the $SO_X$ release speed.

The inventors discovered that even if performing sulfur poisoning recovery treatment, sometimes it is not possible to make all of the $SO_X$ which is stored in the $NO_X$ storage reduction catalyst be released. In the present invention, the $SO_X$ amount which finally remains even if performing sulfur poisoning recovery treatment is called the "residual $SO_X$ storage amount".

Figure 6:
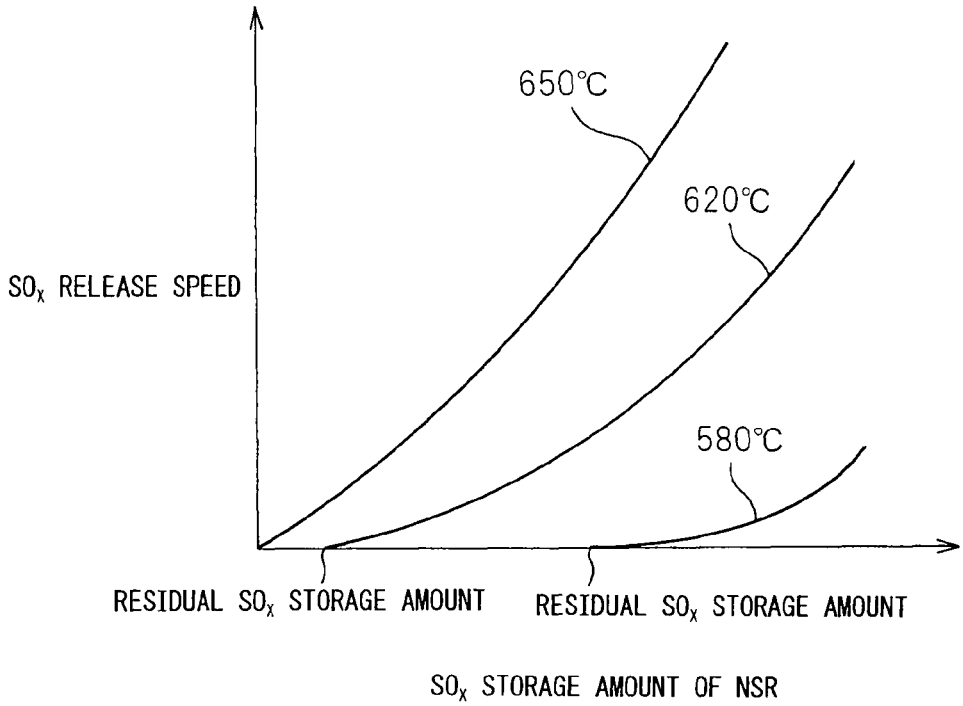
FIG. 6 is a graph which explains a relationship between an $SO_X$ amount which is stored in an $NO_X$ storage reduction catalyst device and a $SO_X$ release speed in Embodiment 1.

FIG. 6 is a graph which explains the relationship between the $SO_X$ storage amount and $SO_X$ release speed of the $NO_X$ storage reduction catalyst. The abscissa shows the $SO_X$ storage amount of the $NO_X$ storage reduction catalyst, while the ordinate shows the $SO_X$ release speed. FIG. 6 shows an example of performing $SO_X$ release control at a bed temperature of the $NO_X$ storage reduction catalyst of 650° C., 620° C., or 580° C. It is learned that the greater the $SO_X$ storage amount, the larger the $SO_X$ release speed.

Figure 7:
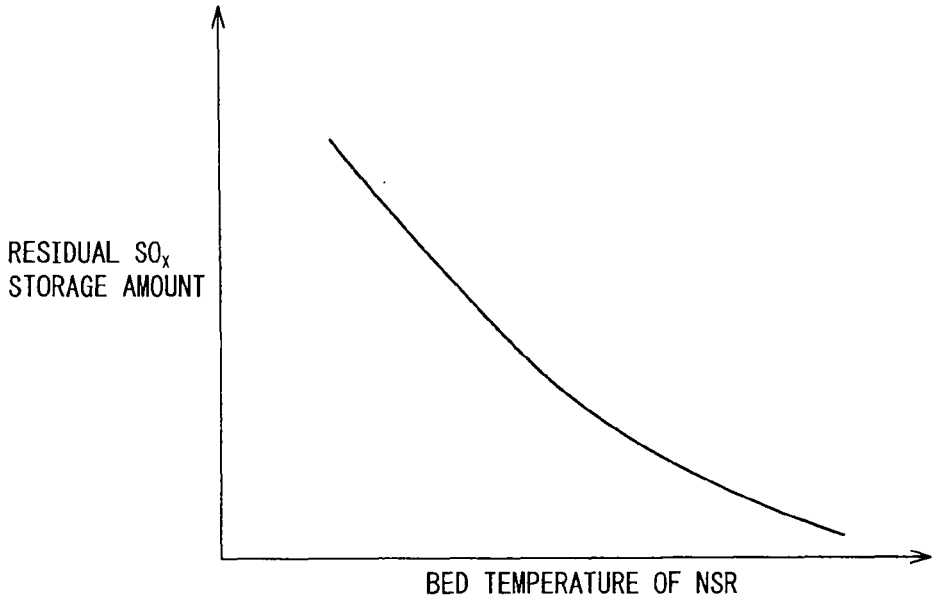
FIG. 7 is a graph of a bed temperature of an $NO_X$ storage reduction catalyst device and a finally remaining residual $SO_X$ storage amount in Embodiment 1.

It is learned that when the bed temperature of the $NO_X$ storage reduction catalyst is 650° C., the $SO_X$ release speed is larger than zero until the $SO_X$ storage amount becomes substantially zero. That is, when the bed temperature of the $NO_X$ storage reduction catalyst is 650° C., it is possible to release substantially all of the stored $SO_X$. As opposed to this, as the bed temperature of the $NO_X$ storage reduction catalyst becomes lower, cases appear where the $SO_X$ release speed becomes zero despite $SO_X$ remaining at the $NO_X$ storage reduction catalyst. In this way, at a predetermined temperature or less, even if performing $SO_X$ release control, $SO_X$ remains at the $NO_X$ storage reduction catalyst FIG. 7 shows the relationship between the bed temperature of the $NO_X$ storage reduction catalyst and the residual $SO_X$ storage amount. The abscissa shows the bed temperature of the $NO_X$ storage reduction catalyst when performing $SO_X$ release control. The ordinate shows the residual $SO_X$ storage amount which finally remains even if performing $SO_X$ release control. When the temperature of the $NO_X$ storage reduction catalyst is low, the residual $SO_X$ storage amount becomes larger. As the temperature of the $NO_X$ storage reduction catalyst becomes higher, the residual $SO_X$ storage amount becomes smaller. In this way, the inventors clarified that sometimes $SO_X$ is not completely released and remains at the $NO_X$ storage reduction catalyst. Further, the inventors clarified that the residual $SO_X$ storage amount depends on the temperature of the $NO_X$ storage reduction catalyst when performing $SO_X$ release control.

Figure 8:
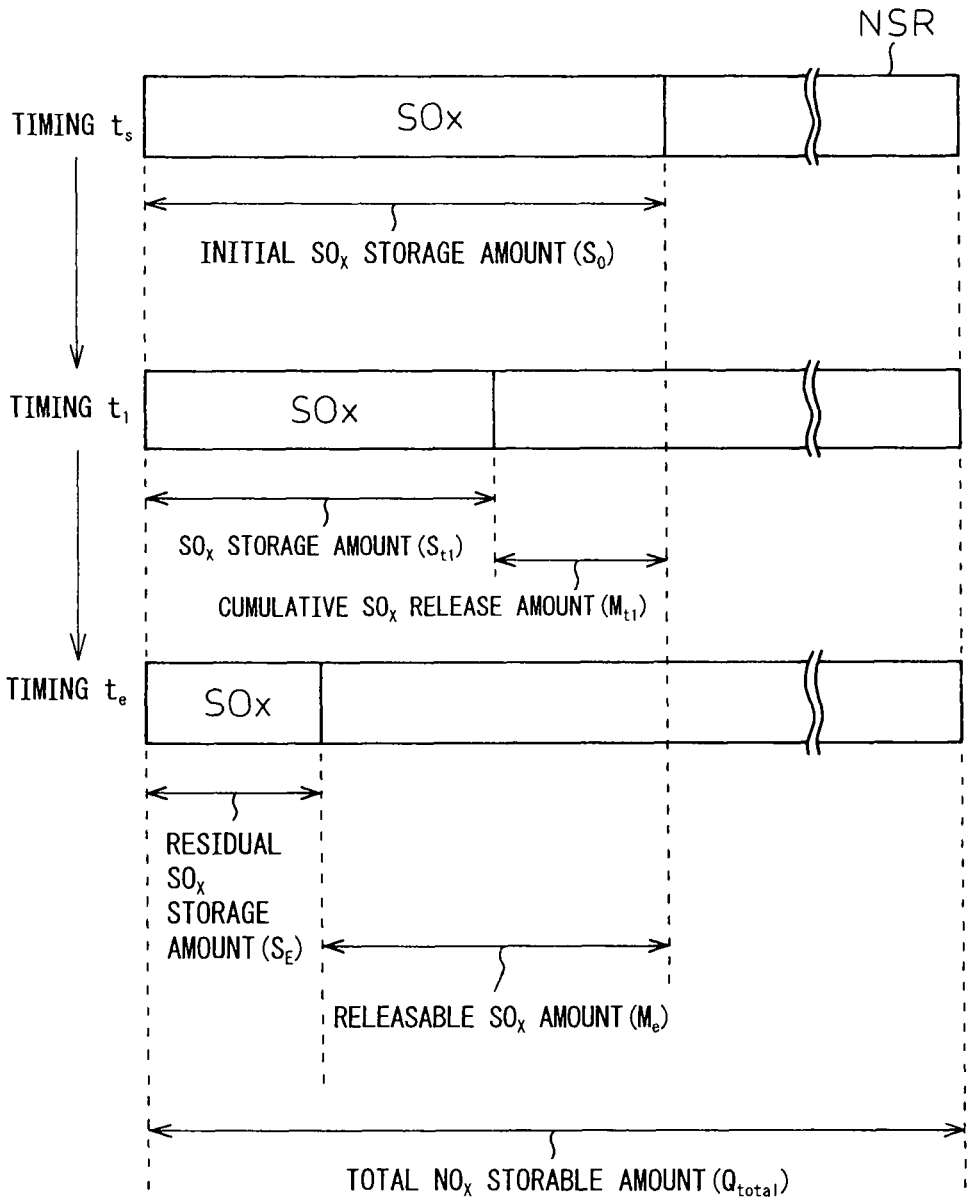
FIG. 8 is a view which explains changes in an $SO_X$ amount which is stored in an $NO_X$ storage reduction catalyst device in $SO_X$ release control.

FIG. 8 schematically shows the $SO_X$ amount which remains at the $NO_X$ storage reduction catalyst when performing $SO_X$ release control. The timing $t_s$ is the timing when starting $SO_X$ release control. The timing $t_e$ is the timing of ending the $SO_X$ release control. In the present embodiment, the time when the $SO_X$ storage amount becomes the residual $SO_X$ storage amount is made the end timing $t_e$. The timing $t_1$ is any timing when performing $SO_X$ release control.

The total $NO_X$ storable amount $Q_{total}$ is the maximum amount of $NO_X$ which the $NO_X$ storage reduction catalyst can store. The $NO_X$ storage reduction catalyst stores $NO_X$ and stores $SO_X$. At the timing $t_s$, the $NO_X$ storage reduction catalyst stores the initial $SO_X$ storage amount $S_0$ of $SO_X$. By performing $SO_X$ release control, $SO_X$ is released. The $SO_X$ storage amount $S_{t1}$ at the timing $t_1$ becomes smaller than the initial $SO_X$ storage amount $S_0$. In the present embodiment, the system detects when the $SO_X$ storage amount reaches the residual $SO_X$ storage amount $S_e$ and ends $SO_X$ release control.

In the present embodiment, the system precisely detects the amount of $SO_X$ which is released from the $NO_X$ storage reduction catalyst, that is, the $SO_X$ release amount. It precisely detects the timing $t_e$ when the $SO_X$ storage amount $S_{t1}$ of the $NO_X$ storage reduction catalyst becomes the residual $SO_X$ storage amount $S_e$.

In the present embodiment, when performing $SO_X$ release control, the system calculates the $SO_X$ release speed at every predetermined interval. It is possible to multiply the calculated $SO_X$ release speed with predetermined intervals to calculate the $SO_X$ amount which is released at predetermined intervals. By cumulatively adding the calculated $SO_X$ release amount, it is possible to calculate the cumulative $SO_X$ release amount $M_{t1}$ from the start of the $SO_X$ release control to any timing. It is possible to subtract from the initial $SO_X$ storage amount $S_0$ the cumulative $SO_X$ release amount $M_{t1}$ to thereby calculate the $SO_X$ storage amount $S_{t1}$ at any timing.

In the present embodiment, the system considers the finally remaining residual $SO_X$ storage amount $S_e$ to calculate the $SO_X$ release speed. In the present embodiment, when calculating the $SO_X$ release speed R, the $SO_X$ storage amount $S_{t1}$ of the $NO_X$ storage reduction catalyst is used to calculate the $SO_X$ storage amount $S_{t1}$* when corrected by the following formula (3):

$$S_{t1}^*=S_{t1}\times(1-S_e/S_{t1}=S_{t1}-S_e \quad (3)$$

For example, in the formula (1) or formula (2), the $SO_X$ storage amount $S_{t1}$* after correction is entered instead of the $SO_X$ storage amount $S_{t1}$ so as to calculate the $SO_X$ release speed at the current timing. That is, the $SO_X$ release speed $R_{t1}$ at the timing $t_1$ can be expressed by the following formula by modifying the formula (1).

$$R_{t1}=f(T_{t1},S_{t1}^*,CO_{t1}) \quad (4)$$

In this way, the difference between the $SO_X$ storage amount at each timing and the residual $SO_X$ storage amount can be used as the basis to calculate the $SO_X$ release speed at each timing.

Figure 9:
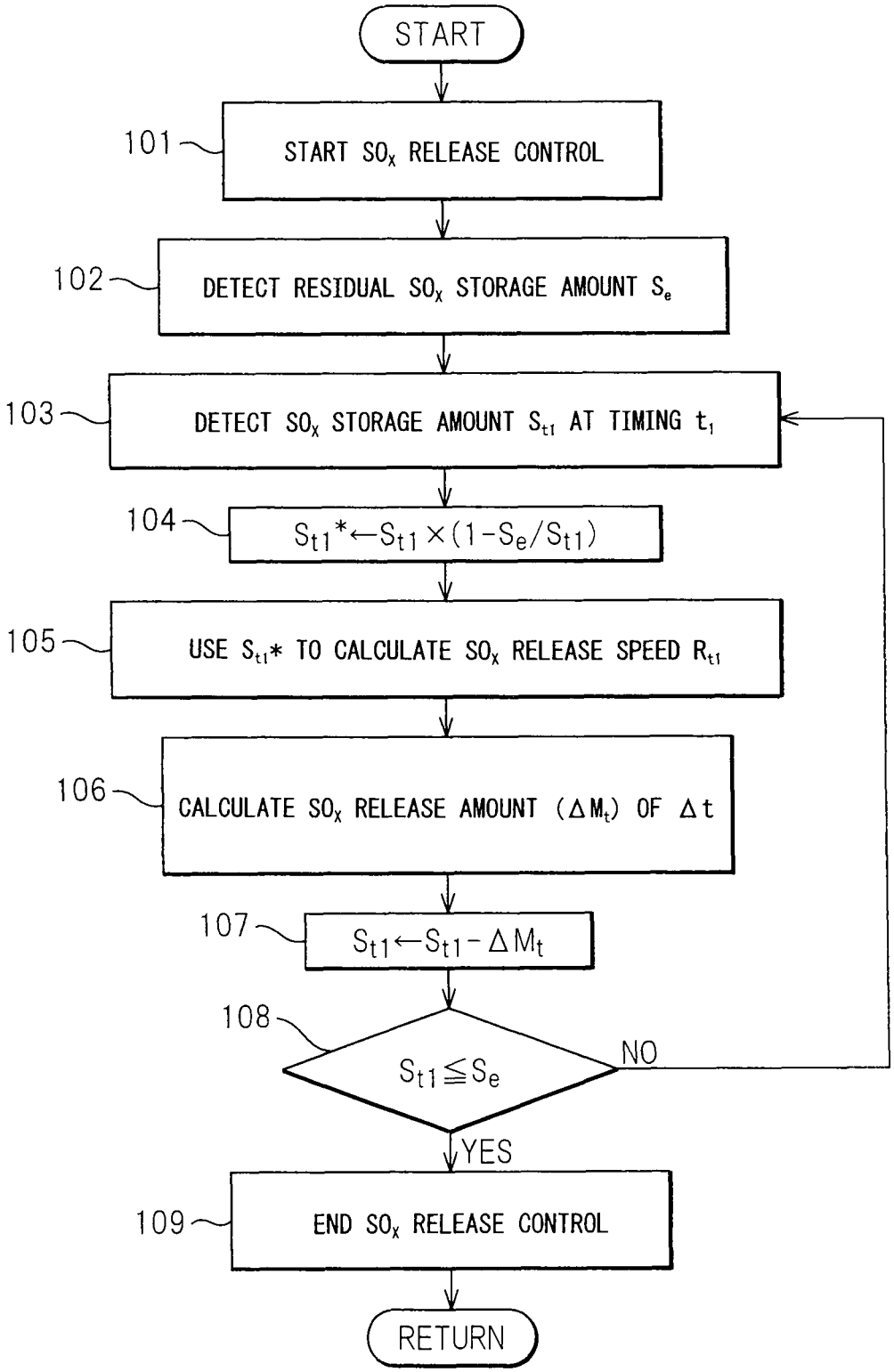
FIG. 9 is a flow chart for when performing $SO_X$ release control in Embodiment 1.

FIG. 9 is a flow chart of the time when performing $SO_X$ release control in the present embodiment. When the $SO_X$ amount which is stored in the $NO_X$ storage reduction catalyst exceeds the allowable value, the sulfur poisoning recovery treatment is started. Temperature elevation control is performed, then, at step 101, $SO_X$ release control is started.

Next, at step 102, the residual $SO_X$ storage amount $S_e$ is detected. First, the temperature of the $NO_X$ storage reduction catalyst is detected. Referring to FIG. 1, the temperature of the $NO_X$ storage reduction catalyst 17 can be detected, for example, by a temperature sensor 26 which is arranged downstream of the $NO_X$ storage reduction catalyst 17. As explained above, the residual $SO_X$ storage amount depends on the temperature. The exhaust purification system of an internal combustion engine in the present embodiment is provided with a map of the residual $SO_X$ storage amount as a function of the temperature of the $NO_X$ storage reduction catalyst. The map of the residual $SO_X$ storage amount is, for example, stored in the ROM 32 of the electronic control unit 30. The temperature of the $NO_X$ storage reduction catalyst 17 and map are used to detect the residual $SO_X$ storage amount $S_e$.

Next, at step 103, the $SO_X$ storage amount $S_{t1}$ at the current timing $t_1$ is read. Right after the $SO_X$ release control is started, the initial $SO_X$ storage amount $S_0$ which is stored in the $NO_X$ storage reduction catalyst becomes the $SO_X$ storage amount $S_{t1}$ of the current timing.

Next, at step 104, to calculate the $SO_X$ release speed, the corrected $SO_X$ storage amount $S_{1t}$ is calculated. The $SO_X$ storage amount $S_{t1}$ at the timing $t_1$ and the residual $SO_X$ storage amount $S_e$ can be used to calculate the $SO_X$ storage amount $S_{t1}$* after correction by the formula (3).

Next, at step 105, the $SO_X$ storage amount $S_{t1}$* after correction is used to calculate the $SO_X$ release speed $R_{t1}$, at the timing $t_1$ by, for example, formula (4).

Alternatively, when using the formula (2) to calculate the $SO_X$ release speed, it is possible to find the concentration of sulfates $[SO_X]$ from the $SO_X$ storage amount $S_{t1}$* after correction so as to calculate the $SO_X$ release speed $R_{t1}$. The concentration [CO] of the reducing agent can for example be calculated from the amount of fuel which is injected into the combustion chambers, the intake air flow amount, the temperature of the exhaust gas, etc.

Next, at step 106, the $SO_X$ release amount $\Delta M_t$ during a micro time $\Delta t$ is calculated.

$$\Delta M_t=R_{t1}\times\Delta t \quad (5)$$

The micro time $\Delta t$ used may be any time. The micro time $\Delta t$ is the length of the interval for calculating the $SO_X$ release speed. The micro time $\Delta t$ is the time from when calculating the $SO_X$ release speed to when calculating the next $SO_X$ release speed.

Next, at step 107, the current $SO_X$ storage amount is reduced by the $SO_X$ release amount $\Delta M_t$ of the micro time $\Delta t$ so as to calculate the new $SO_X$ storage amount.

Next, at step 108, it is judged if the calculated $SO_X$ storage amount $S_{t1}$ is the residual $SO_X$ storage amount $S_e$ or less. When the $SO_X$ storage amount $S_{t1}$ becomes larger than the residual $SO_X$ storage amount $S_e$, the routine returns to step 103 where this calculation is repeated. In this way, it is possible to calculate the $SO_X$ storage amount $S_{t1}$ at any timing $t_1$.

At step 108, when the $SO_X$ storage amount $S_{t1}$ is the residual $SO_X$ storage amount $S_e$ or less, the routine proceeds to step 109 where the $SO_X$ release control is ended. In this way, the fact of the $SO_X$ storage amount reaching the residual $SO_X$ storage amount is detected.

Figure 10:
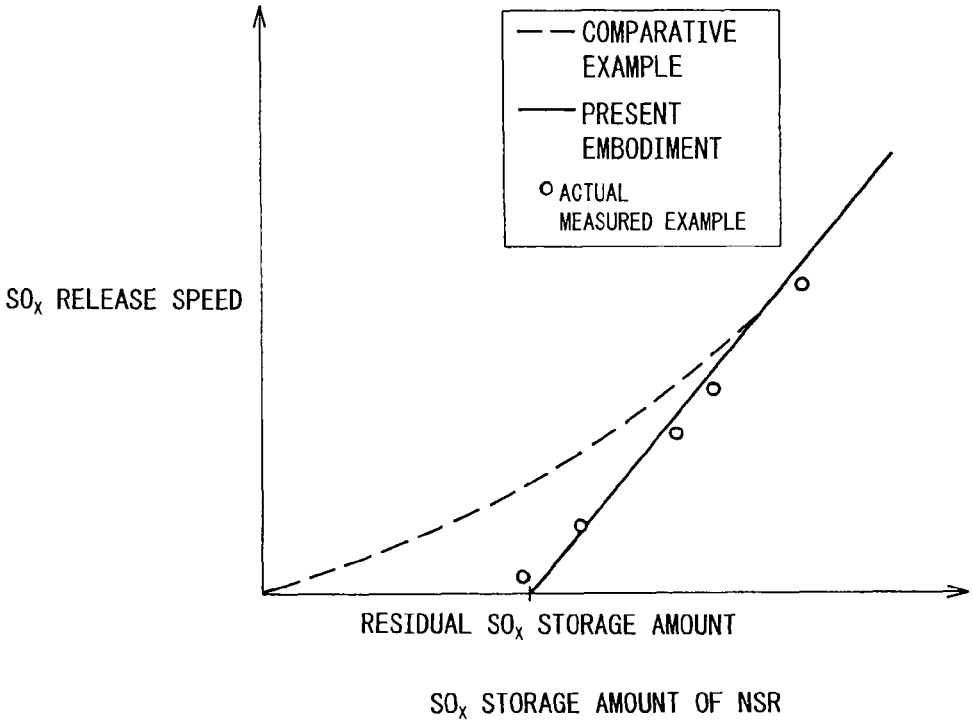
FIG. 10 is a graph of a case of using a correction term to calculate an $SO_X$ release speed in Embodiment 1 and a comparative example which calculates an $SO_X$ release speed without using a correction term.

FIG. 10 shows a graph of the $SO_X$ release speed which is calculated by the method of calculation in the present embodiment and a graph of a comparative example where the calculation is performed without considering the residual $SO_X$ storage amount. Further, FIG. 10 shows the points of examples measuring the $SO_X$ release speed by experiments.

In the comparative example, the calculation is performed without correction of the $SO_X$ storage amount $S_{t1}$ shown in formula (3). In the graph of the comparative example, there is an $SO_X$ release speed until the $SO_X$ storage amount of the $NO_X$ storage reduction catalyst becomes zero. As opposed to this, in the example of calculation in the present embodiment, if the $SO_X$ storage amount of the $NO_X$ storage reduction catalyst becomes the residual $SO_X$ storage amount, the $SO_X$ release speed becomes zero. It is learned that the examples of calculation of the present embodiment match with the actually measured values well.

In the present embodiment, the residual $SO_X$ storage amount of the current $SO_X$ release control is used as the basis to calculate the $SO_X$ release speed at each timing in the current $SO_X$ release control. By adopting this configuration, when performing $SO_X$ release control, the remaining $SO_X$ is considered and the $SO_X$ release speed can be calculated precisely. In particular, in the present embodiment, the difference between the $SO_X$ storage amount at each timing in the current $SO_X$ release control and the residual $SO_X$ storage amount is used as the basis to calculate the $SO_X$ release speed at each timing. Due to this configuration it is possible to calculate the $SO_X$ release speed precisely by simple control.

Further, in the present embodiment, to calculate the $SO_X$ release speed at each timing, it is possible to precisely calculate the $SO_X$ release amount from the $NO_X$ storage reduction catalyst. Alternatively, it is possible to precisely calculate the $SO_X$ storage amount which remains at the $NO_X$ storage reduction catalyst. It is possible to precisely judge the end timing of the $SO_X$ release control. As result, it is possible to avoid the time for $SO_X$ release control becoming longer than necessary. It is possible to suppress thermal degradation of the $NO_X$ storage reduction catalyst. Alternatively, it is possible to avoid fuel being consumed more than necessary when performing auxiliary injection at the combustion chambers.

In the present embodiment, the $SO_X$ release control is ended when the $SO_X$ storage amount becomes the residual $SO_X$ storage amount, but the invention is not limited to this mode. It is possible to make the $SO_X$ release control end at any $SO_X$ storage amount.

Further, the formula for calculating the $SO_X$ release speed is not limited to the formula (2). It is possible to apply the correction term of the formula (3) in the present embodiment to any formula (1) for calculating the $SO_X$ release speed. Further, the correction of the $SO_X$ release speed is not limited to the mode. It is possible to employ any correction considering the residual $SO_X$ storage amount.

The sulfur poisoning recovery treatment is performed each time the $SO_X$ amount which is stored in the $NO_X$ storage catalyst increases and reaches the allowable value. When performing the sulfur poisoning recovery treatment a plurality of times, the temperature of the $NO_X$ storage reduction catalyst at the time when performing the $SO_X$ release control may be changed each time.

Embodiment 2

Referring to FIG. 1, FIG. 6, FIG. 8, and FIG. 11 to FIG. 15, an exhaust purification system of an internal combustion engine in Embodiment 2 will be explained. In the present embodiment, the formula for calculating the $SO_X$ release speed is used corrected.

Referring to FIG. 6, the $SO_X$ release speed is decreased in accordance with a decrease of the $SO_X$ storage amount of the $NO_X$ storage catalyst. It is learned that the trend of decrease of the $SO_X$ release speed at this time differs according to the bed temperature of the $NO_X$ storage reduction catalyst. For example, when the bed temperature of the $NO_X$ storage reduction catalyst is 650° C., the graph of the $SO_X$ release speed becomes substantially linear. In this regard, if the bed temperature of the $NO_X$ storage reduction catalyst becomes lower, the graph of the $SO_X$ release speed becomes curved. When the bed temperature of the $NO_X$ storage reduction catalyst is low, there is the trend that after the release of $SO_X$ is started, the $SO_X$ release speed rapidly decreases, then the $SO_X$ release speed gradually decreases. In the present embodiment, a correction term for calculating this trend is incorporated into the formula for calculating the $SO_X$ release speed.

Figure 11:
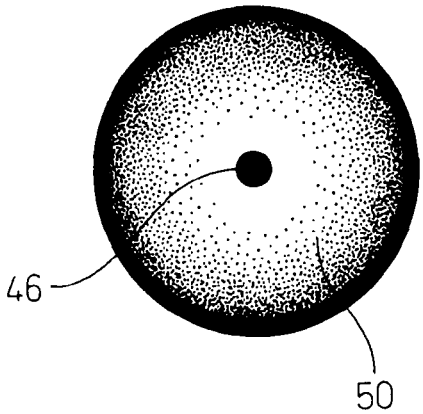
FIG. 11 is an enlarged schematic view which explains a state where $SO_X$ is released at a high temperature from an $NO_X$ storage reduction catalyst device.

FIG. 11 is an enlarged schematic view of an $NO_X$ storage reduction catalyst in the present embodiment. FIG. 11 is an enlarged schematic view of when performing $SO_X$ release control until the $SO_X$ storage amount becomes the residual $SO_X$ storage amount. The $NO_X$ storage reduction catalyst contains the catalyst metal 46. $SO_X$ 50 is contained in the $NO_X$ absorbent in the form of sulfate. If performing $SO_X$ release control, near the catalyst metal 46, a large amount of $SO_X$ 50 is released. In this regard, at a position a predetermined distance from the catalyst metal 46, a large amount of $SO_X$ 50 remains. It is learned that along with the distance from the catalyst metal 46, the remaining $SO_X$ gradually increases.

Figure 12:
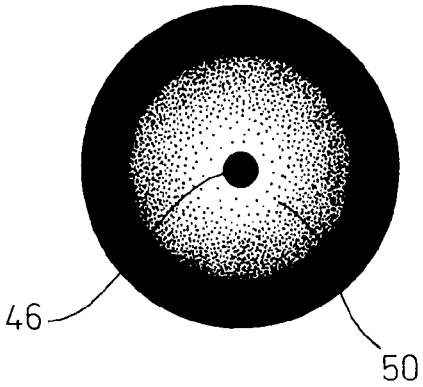
FIG. 12 is an enlarged schematic view which explains a state where $SO_X$ is released at a low temperature from an $NO_X$ storage reduction catalyst device.

FIG. 12 shows another enlarged schematic view of an $NO_X$ storage reduction catalyst in the present embodiment. FIG. 12 is an enlarged schematic view of the time when performing $SO_X$ release control at a lower temperature than the temperature of the $NO_X$ storage reduction catalyst in FIG. 11. By rendering the bed temperature of the $NO_X$ storage reduction catalyst a low temperature to perform the $SO_X$ release control, the $SO_X$ 50 which is released is decreased. Even near the catalyst metal 46, $SO_X$ 50 remains. In the case of this example as well, it is learned that the along with the distance from the catalyst metal 46, the remaining $SO_X$ gradually increases.

Referring to FIG. 11 and FIG. 12, it is learned that if performing $SO_X$ release control, $SO_X$ is released centered about the catalyst metal 46. Further, it is learned that the distance from the catalyst metal 46 at which $SO_X$ is completely released becomes longer the higher the temperature of the $NO_X$ storage reduction catalyst. In this way, it is learned that the higher the temperature of the $NO_X$ storage reduction catalyst, the more possible it is to release $SO_X$ at a position distant from the catalyst metal 46. In the present embodiment, the distance from the catalyst metal 46 is used to create a model of release of $SO_X$.

Figure 13:
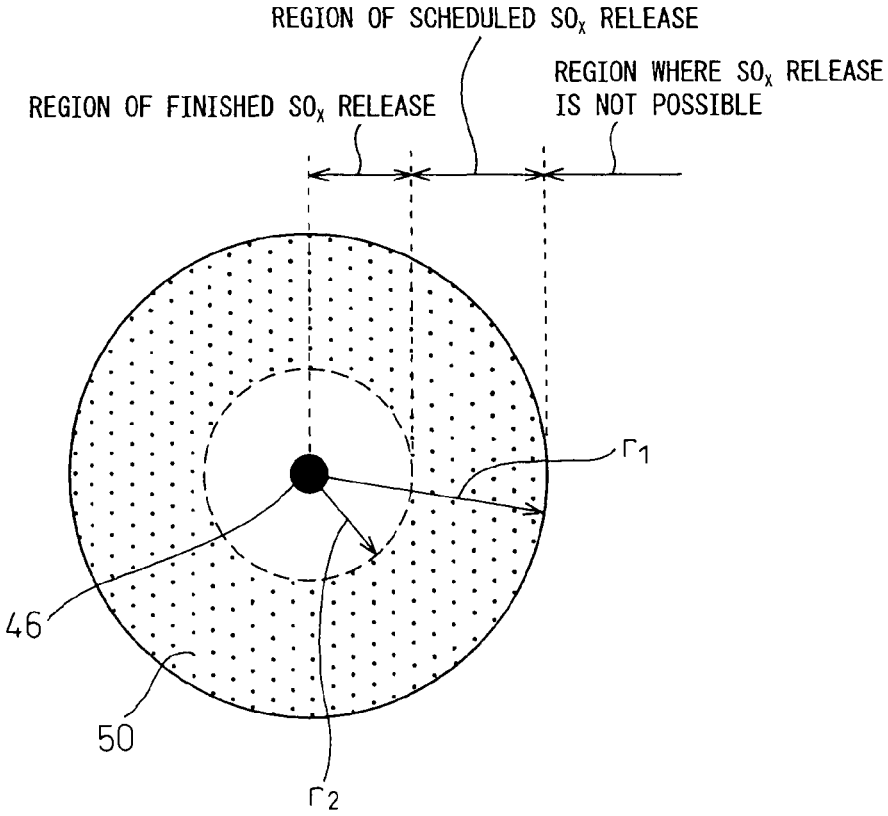
FIG. 13 is a schematic view which explains an $SO_X$ release model.

FIG. 13 shows a schematic view of a model of the release of $SO_X$. In the first release model in the present embodiment, circles are defined centered about the catalyst metal 46. The areas of the circles are deemed to correspond to the $SO_X$ release amount.

A circle of a first radius of a radius $r_1$ is defined centered about the catalyst metal 46. Further, a circle of a second radius of a radius $r_2$ is defined centered about the catalyst metal 46. In this release model, the release of the $SO_X$ proceeds from the catalyst metal 46 toward the outside. The inside of the circle of the radius $r_1$ centered about the catalyst metal 46 corresponds to the region where the $SO_X$ can be released. The outside of the circle of the radius $r_1$ centered about the catalyst metal 46 corresponds to the region where $SO_X$ cannot be released and $SO_X$ remains. The radius $r_1$ depends on the bed temperature of the $NO_X$ storage reduction catalyst when performing $SO_X$ release control. The inside of the circle of the radius $r_2$ is a region releasing $SO_X$ up to any timing. The radius $r_2$ gradually becomes larger as the $SO_X$ release control proceeds. The radius $r_2$ can become larger up to the radius $r_1$.

When considering the release model of FIG. 13, the concentration of the sulfate $BaSO_4$ which can be involved in the reduction reaction is calculated by the following formula:

$$[BaSO_4]^*=[BaSO_4](1-r_2/r_1) \quad (6)$$

The concentration of sulfates is multiplied with the correction term $(1-r_2/r_1)$ to calculate the concentration of sulfates after correction. Similarly, the $SO_X$ release speed $R_{t1}$* after correction is expressed by the following formula using the $SO_X$ release speed $R_{t1}$ before correction.

$$R_{t1}^*=R_{t1}\times(1-r_2/r_1) \quad (7)$$

Formula (7) shows that as the radius $r_2$ approaches the radius $r_1$, the $SO_X$ release speed approaches zero. That is, this shows that as the $SO_X$ storage amount $S_{t1}$ approaches the residual $SO_X$ storage amount $S_e$, the $SO_X$ release speed approaches zero. Further, the formula (7) shows that even with the same value of the radius $r_2$, if the radius $r_1$ is large, the $SO_X$ release speed $R_{t1}$* after correction becomes larger. That is, this shows that even if the $SO_X$ storage amount $S_{t1}$ is the same, if the $NO_X$ storage reduction catalyst is a high temperature, the $SO_X$ release speed $R_{t1}$* after correction becomes larger. Further, this shows that the $SO_X$ release speed $R_{t1}$* after correction decreases linearly along with a decrease of the $SO_X$ storage amount when the radius $r_1$ is large.

Next, the ratio of the radius $r_1$ and the radius $r_2$ included in the formula (7) is calculated. In the first release model, the $SO_X$ release amount is made to correspond to the area of the circle shown in FIG. 13. That is, the $SO_X$ release amount is given by the following formula:

$$\pi r^2 \propto SO_X \text{ release amount} \quad (8)$$

Referring to FIG. 8 and FIG. 13, the area of the circle of the radius $r_1$ corresponds to the releasable $SO_X$ amount (final $SO_X$ release amount) $M_e$. The releasable $SO_X$ amount $M_e$ is the value of the $SO_X$ storage amount $S_0$ when starting the $SO_X$ release control minus the residual $SO_X$ storage amount $S_e$. Further, the area of the circle of the radius $r_2$ corresponds to the cumulative $SO_X$ release amount $M_{t1}$ which is released from the timing $t_s$ to the timing $t_1$. It is possible to use formula (8) to calculate the radius $r_1$.

$$\pi r_1^2 \propto M_e \quad (9)$$

$$\pi r_1^2=kM_e(k\text{:constant})$$

$$r_1=(k/\pi\times M_e)^{1/2} \quad (10)$$

Next, in the same way as deriving the radius $r_1$, the formula (8) may be used to calculate the radius $r_2$.

$$\pi r_2^2 \propto M_{t1} \quad (11)$$

$$\pi r_2^2=kM_{t1}(k\text{:constant})$$

$$r_2=(k/\pi\times M_{t1})^{1/2} \quad (12)$$

From formula (10) and formula (12), the ratio of the radius $r_1$ and the radius $r_2$ can be calculated by the following formula:

$$r_2/r_1=(M_{t1}/M_e)^{1/2} \quad (13)$$

In this way, the ratio of the radius $r_1$ and the radius $r_2$ can be calculated from the releasable $SO_X$ amount $M_e$ and the cumulative $SO_X$ release amount $M_{t1}$ which is released from the timing $t_s$ to the timing $t_1$. Furthermore, it is possible to enter the value calculated by the formula (13) into the formula (7) so as to calculate the $SO_X$ release speed $R_{t1}$* after correction.

$$R_{t1}^*=R_{t1}\times(1-(M_{t1}/M_e)^{1/2} \quad (14)$$

Figure 14:
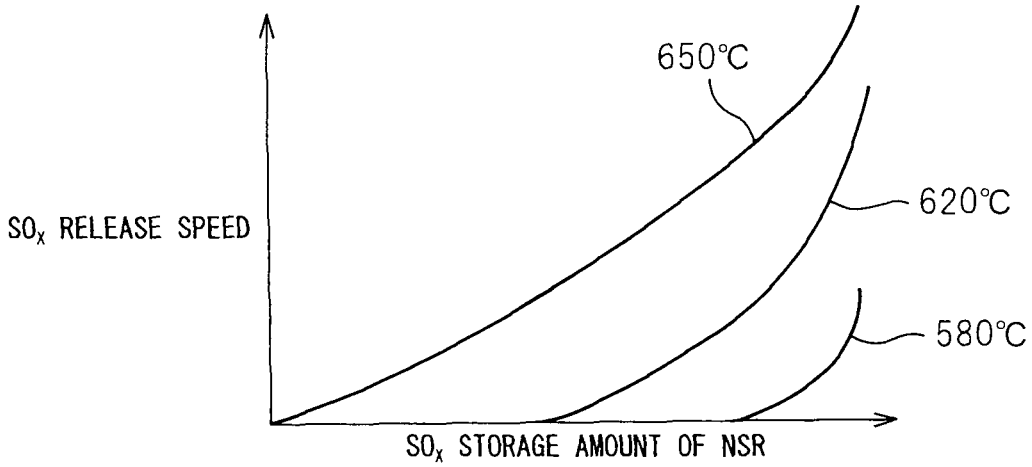
FIG. 14 is a graph of an $SO_X$ release speed when using a calculated correction term for calculation in Embodiment 2.

FIG. 14 shows a graph of the results of calculations performed by the first release model of the present embodiment. The abscissa shows the $SO_X$ storage amount of the $NO_X$ storage reduction catalyst, while the ordinate shows the $SO_X$ release speed. When the $SO_X$ storage amount is large, a trend is shown where the $SO_X$ release speed greatly decreases along with the decrease of the $SO_X$ storage amount. If the $SO_X$ storage amount becomes smaller, a trend is shown where the $SO_X$ release speed decreases slightly along with the decrease of the $SO_X$ storage amount. Further, the higher the bed temperature of the $NO_X$ storage reduction catalyst, the greater this trend and the more curved the graph shown.

In this way, in the first release model, the calculated $SO_X$ release speed may be corrected based on the radius $r_1$ and radius $r_2$ so as to precisely calculate the $SO_X$ release speed.

Figure 15:
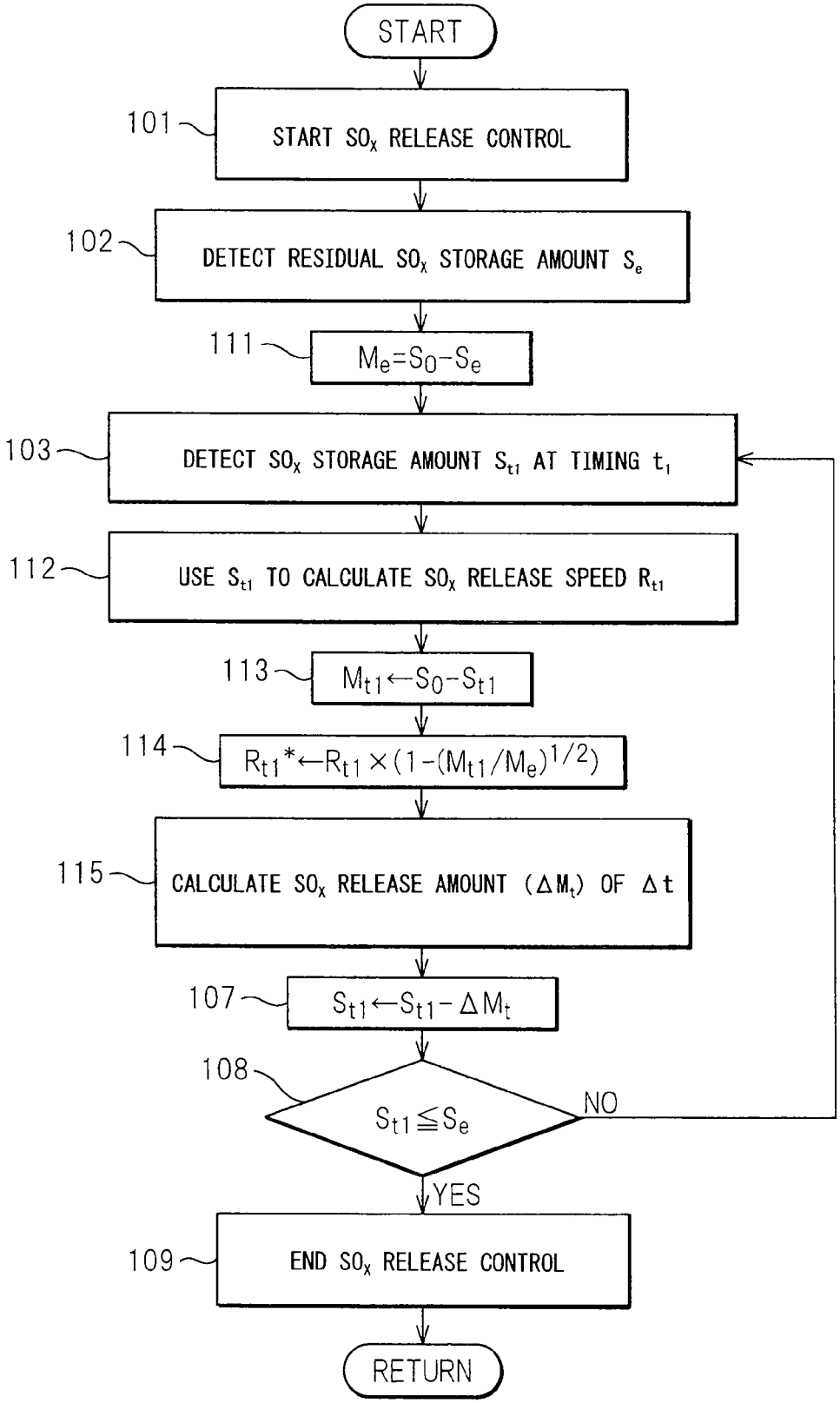
FIG. 15 is a flow chart for when performing $SO_X$ release control in Embodiment 2.

FIG. 15 shows a flow chart for when performing the $SO_X$ release control in the present embodiment. At step 101, the $SO_X$ release control is started. At step 102, the residual $SO_X$ storage amount $S_e$ is detected. Step 101 and step 102 are similar to Embodiment 1.

Next, at step 111, the initial $SO_X$ storage amount $S_0$ is reduced by the residual $SO_X$ storage amount $S_e$ to calculate the releasable $SO_X$ amount $M_e$ (see FIG. 8). Next, at step 103, the $SO_X$ storage amount $S_{t1}$ at the current timing $t_1$ is detected.

Next, at step 112, the detected $SO_X$ storage amount $S_{t1}$ is used to calculate the $SO_X$ release speed $R_{t1}$ before correction by the formula (1). Further, at step 113, the initial $SO_X$ storage amount $S_0$ is reduced by the $SO_X$ storage amount $S_{t1}$ at the timing $t_1$ to calculate the cumulative $SO_X$ release amount $M_{t1}$.

Next, at step 114, the $SO_X$ release speed $R_{t1}$* after correction is calculated. The releasable $SO_X$ amount $M_e$ and the cumulative $SO_X$ release amount $M_u$ can be used to calculate the $SO_X$ release speed $R_{t1}$* after correction by the above formula (14).

Next, at step 115, the $SO_X$ release speed $R_{t1}$* after correction is used to calculate the $SO_X$ release amount ($\Delta M_t$) of the micro time $\Delta t$. Next, at step 107, the current $SO_X$ storage amount may be reduced by the released $SO_X$ amount to calculate a new $SO_X$ storage amount. Step 107 to step 109 are similar to Embodiment 1.

In this way, in the present embodiment, it is possible to use the $SO_X$ release speed after correction to calculate the $SO_X$ release amount to thereby calculate a more accurate $SO_X$ release amount. Alternatively, it is possible to precisely calculate the $SO_X$ storage amount which is stored in the $NO_X$ storage catalyst.

Next, the second release model in the present embodiment will be explained. In the second release model in the present embodiment, a sphere is defined centered about the catalyst metal 46. That is, the range of release of $SO_X$ defined in the first release model is made not a circle, but a sphere. In the second release model, the $SO_X$ release amount is deemed to correspond to the volume of the sphere. That is, the $SO_X$ release amount is given by the following formula:

$$(4/3)\pi r^3 \propto SO_X \text{ release amount} \quad (15)$$

In the second release model, the volume of the sphere of the first radius comprised of the radius $r_1$ corresponds to the releasable $SO_X$ amount $M_e$. The volume of the sphere of the second radius comprised of the radius $r_2$ corresponds to the cumulative $SO_X$ release amount $M_{t1}$ which was released from the timing $t_s$ to the timing $t_1$. The formula (15) is used to derive the following formulas:

$$(4/3)\pi r_1^3 = kM_e (k\text{:constant}) \quad (16)$$

$$(4/3)\pi r_2^3 = kM_{t1} (k\text{:constant}) \quad (17)$$

From formula (16) and formula (17), the ratio of the radius $r_1$ and the radius $r_2$ can be calculated by the following formula:

$$r_2/r_1 = (M_{t1}/M_e)^{1/3} \quad (18)$$

The ratio of the radius $r_1$ and the radius $r_2$ can be calculated by the releasable $SO_X$ amount $M_e$ and the cumulative $SO_X$ release amount $M_{t1}$ which was released from the timing $t_s$ to the timing $t_1$. Furthermore, formula (18) may be entered into the formula (7) so as to calculate the $SO_X$ release speed $R_{t1}$* after correction.

$$R_{t1}^* = R_{t1} \times (1-(M_{t1}/M_e)^{1/3}) \quad (19)$$

In the second release model as well, the calculated $SO_X$ release speed may be corrected based on the radius $r_1$ and the radius $r_2$ to precisely calculate the $SO_X$ release speed. Further, the corrected formula of the $SO_X$ release speed may be used to calculate the $SO_X$ release amount to enable more accurate calculation of the $SO_X$ release amount. Alternatively, it is possible to precisely calculate the $SO_X$ storage amount which is stored in the $NO_X$ storage catalyst.

The rest of the configuration, action, and effects are similar to those of Embodiment 1, so the explanations will not be repeated here.

Embodiment 3

Referring to FIG. 1, FIG. 7, FIG. 8, and FIG. 16 to FIG. 18, an exhaust purification system of an internal combustion engine in Embodiment 3 will be explained. In the present embodiment, the correction term of the $SO_X$ release speed which was explained in Embodiment 2 is calculated using the $NO_X$ storable amount of the $NO_X$ storage reduction catalyst. That is, the ratio of the radius $r_1$ and the radius $r_2$ is calculated from the $NO_X$ storable amount which shows the amount of $NO_X$ which can be stored.

Figure 16:
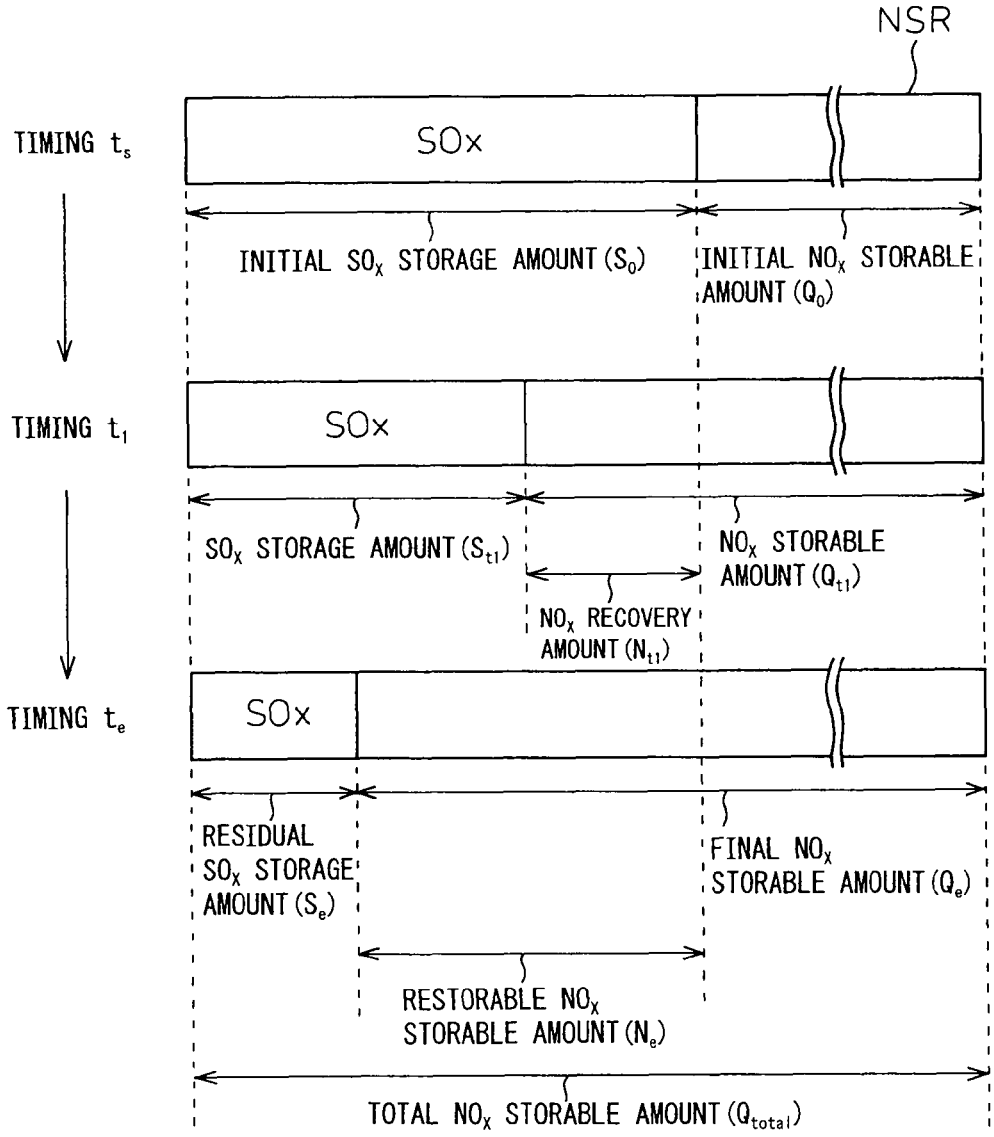
FIG. 16 is a view which explains a change of an $NO_X$ storable amount of an $NO_X$ storage reduction catalyst device in $SO_X$ release control.

FIG. 16 schematically shows the $NO_X$ storable amount when performing $SO_X$ release control in the sulfur poisoning recovery treatment. The timing $t_s$ is the timing when starting the $SO_X$ release control, while the timing $t_e$ is the timing when ending the $SO_X$ release control. In the present embodiment, the time when the $SO_X$ storage amount becomes the residual $SO_X$ storage amount is made the end timing $t_e$. The timing $t_1$ is any timing when performing the $SO_X$ release control.

The $NO_X$ storage reduction catalyst has an initial $NO_X$ storable amount $Q_0$ at the timing $t_s$. By performing $SO_X$ release control, the $SO_X$ is released. The $NO_X$ storable amount $Q_{t1}$ at the timing $t_1$ becomes larger than the initial $NO_X$ storable amount $Q_0$. That is, the $NO_X$ storable amount is restored. When performing the $SO_X$ release control until the $SO_X$ storage amount becomes the residual $SO_X$ storage amount $S_e$, the $NO_X$ storable amount becomes the final $NO_X$ storable amount $Q_e$.

In the first release model in the present embodiment, in the same way as the first release model in Embodiment 2, a circle is defined centered about the catalyst metal 46. The area of the circle is deemed to correspond to the $SO_X$ release amount (see FIG. 13). Furthermore, in the present embodiment, the $SO_X$ release amount is replaced with the $NO_X$ recovery amount to calculate the ratio of the radius $r_1$ and the radius $r_2$. The ratio of the radius $r_1$ and the radius $r_2$ becomes the following formula.

$$r_2/r_1 = (N_{t1}/N_e)^{1/2} \quad (20)$$

Here, the variable $N_e$ is the recoverable $NO_X$ storable amount (final $NO_X$ recovery amount) which shows the recovery amount when performing $SO_X$ release control from the timing $t_s$ to when the $SO_X$ storage amount becomes the residual $SO_X$ storage amount $S_e$. The variable $N_{t1}$ is the $NO_X$ storable amount which is recovered from the timing $t_s$ to the timing $t_1$ and is called the "$NO_X$ recovery amount".

Figure 17:
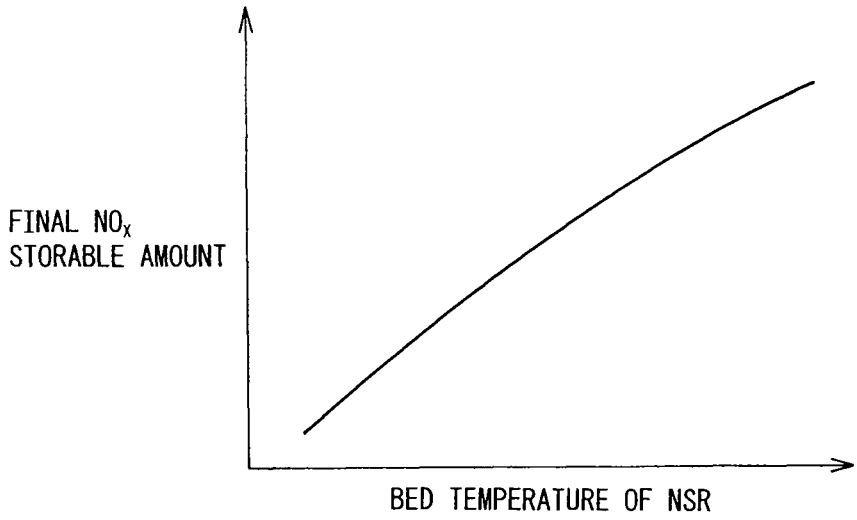
FIG. 17 is a graph which explains a relationship between a temperature of an $NO_X$ storage reduction catalyst device and a final $NO_X$ storable amount for when unreleasable $SO_X$ remains in Embodiment 3.

FIG. 17 shows a graph of the relationship between the final $NO_X$ storable amount and the bed temperature of the $NO_X$ storage reduction catalyst when performing $SO_X$ release control. It is learned that as the temperature of the $NO_X$ storage reduction catalyst becomes higher, the final $NO_X$ storable amount $Q_e$ becomes larger. As shown in FIG. 7, by the temperature of the $NO_X$ storage reduction catalyst becoming higher, the residual $SO_X$ storage amount $S_e$ becomes smaller, so this trend appears.

In the present embodiment, the relationship shown in FIG. 17 is used as the basis to prepare in advance a map of the final $NO_X$ storable amount $Q_e$ as a function of the bed temperature of the $NO_X$ storage reduction catalyst. This is stored in the electronic control unit 30. It is possible to detect the temperature of the $NO_X$ storage reduction catalyst and use the map of the $NO_X$ storable amount so as to detect the final $NO_X$ storable amount $Q_e$.

Alternatively, the final $NO_X$ storable amount $Q_e$ can be calculated by subtracting from the total $NO_X$ storable amount $Q_{total}$ an amount corresponding to the residual $SO_X$ storage amount $S_e$. The total $NO_X$ storable amount $Q_{total}$ is stored in advance in the electronic control unit 30. The residual $SO_X$ storage amount $S_e$ can for example be detected from a map of the residual $SO_X$ storage amount as a function of temperature. The total $NO_X$ storable amount $Q_{total}$ and the residual $SO_X$ storage amount $S_e$ can be used to calculate the final $NO_X$ storable amount $Q_e$.

By subtracting from the final $NO_X$ storable amount $Q_e$ the initial $NO_X$ storable amount $Q_0$, it is possible to calculate the restorable $NO_X$ storable amount $N_e$. The initial $NO_X$ storable amount $Q_0$ can be calculated by subtracting from the final $NO_X$ storable amount $Q_e$ the initial $SO_X$ storage amount $S_0$.

Figure 18:
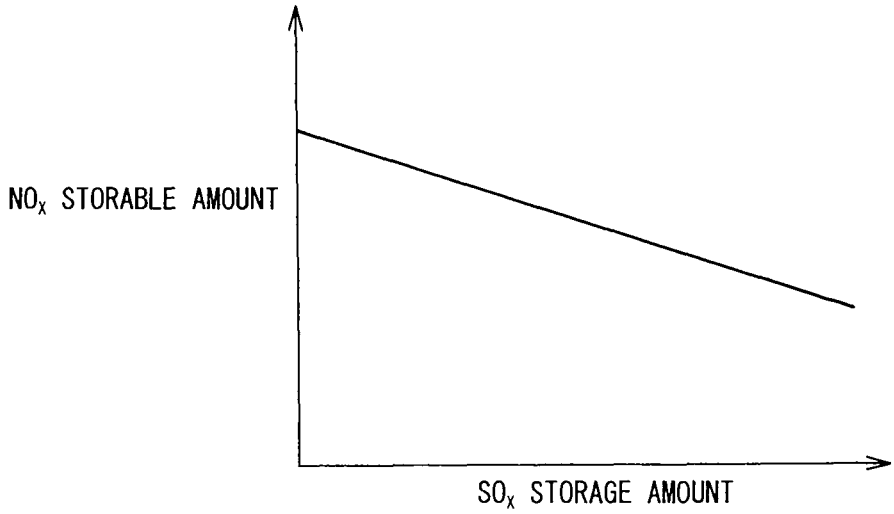
FIG. 18 is a graph which explains a relationship between an $SO_X$ storage amount and an $NO_X$ storable amount in Embodiment 3.

FIG. 18 shows a graph of the $NO_X$ storable amount of the $NO_X$ storage reduction catalyst with respect to the $SO_X$ storage amount. It is learned that the greater the $SO_X$ storage amount, the smaller the $NO_X$ storable amount becomes. The relationship shown in FIG. 18 is used as the basis to prepare in advance a map of an $NO_X$ storable amount as a function of the $SO_X$ storage amount and store it in the electronic control unit 30. By calculating the $SO_X$ storage amount $S_{t1}$ at any timing $t_1$, it is possible to detect the $NO_X$ storable amount $Q_{t1}$ at the timing $t_1$. By subtracting from the $NO_X$ storable amount $Q_{t1}$ at the timing $t_1$ the initial $NO_X$ storable amount $Q_0$ when starting the $SO_X$ release control, it is possible to calculate the $NO_X$ recovery amount $N_{t1}$ at the timing $t_1$.

Alternatively, referring to FIG. 16 and FIG. 8, the $NO_X$ recovery amount $N_{t1}$ corresponds to the cumulative $SO_X$ release amount $M_{t1}$. From the cumulative $SO_X$ release amount $M_{t1}$ up to the timing $t_1$, it is possible to calculate the $NO_X$ recovery amount $N_{t1}$ up to the timing $t_1$. Alternatively, it is possible at step 115 of the flow chart shown in FIG. 15 to calculate the $NO_X$ recovery amount which was restored during $\Delta t$ from the $SO_X$ release amount during $\Delta t$ and cumulatively add this $NO_X$ recovery amount to calculate the $NO_X$ recovery amount $N_{t1}$ at the timing $t_1$.

By entering the calculated restorable $NO_X$ storable amount $N_e$, and $NO_X$ recovery amount $N_{t1}$ into formula (20), the ratio of the radius $r_1$ and the radius $r_2$ can be calculated. By entering the ratio of the radius $r_1$ and the radius $r_2$ into the formula (7), it is possible to calculate the $SO_X$ release speed $R_{t1}$* after correction.

Next, the second release model in the present embodiment will be explained. In the second release model in the present embodiment, in the same way as the second release model in Embodiment 2, a sphere is defined centered about the catalyst metal 46. The volume of the sphere is deemed to correspond to the $SO_X$ release amount. Furthermore, the $SO_X$ release amount is replaced with the $NO_X$ recovery amount to calculate the ratio of the radius $r_1$ and the radius $r_2$.

In the case of the second release model in the present embodiment, the following formula may be used to find the ratio of the radius $r_1$ and the radius $r_2$.

$$r_2/r_1=(N_{t1}/N_e)^{1/2} \tag{21}$$

By entering the value calculated at formula (21) into the formula (7), it is possible to calculate the $SO_X$ release speed $R_{t1}$* after correction.

In the present embodiment, it is possible to precisely calculate the $SO_X$ release speed. By using the formula of the $SO_X$ release speed after correction to calculate the $SO_X$ release amount, it is possible to calculate a more accurate $SO_X$ release amount. Alternatively, it is possible to precisely calculate the $SO_X$ storage amount which is stored in the $NO_X$ storage catalyst.

Further, the exhaust purification system of an internal combustion engine in the present embodiment can replace the $SO_X$ amount which is stored in the $NO_X$ storage reduction catalyst with the $NO_X$ amount for management and control.

The rest of the configuration, action, and effects are similar to those of Embodiment 1 or 2, so the explanations will not be repeated here.

The above embodiments may be suitably combined. In the above figures, the same or corresponding parts are assigned the same reference notations. Note that the above embodiments are illustrations and do not limit the invention. Further, the embodiments include changes shown in the claims.

LIST OF REFERENCE NUMERALS

1 . . . engine body
2 . . . combustion chamber
3 . . . fuel injector
17 . . . $NO_X$ storage reduction catalyst
30 . . . electronic control unit
45 . . . catalyst carrier
46 . . . catalyst metal
47 . . . $NO_X$ absorbent

The invention claimed is:

1. An exhaust purification system of an internal combustion engine which arranges in an engine exhaust passage an $NO_X$ catalyst device which stores $NO_X$ which is contained in exhaust gas when an air-fuel ratio of the inflowing exhaust gas is lean and which releases the stored $NO_X$ when the air-fuel ratio of the inflowing exhaust gas becomes a stoichiometric air-fuel ratio or rich and which uses $SO_X$ release control which raises a temperature of the $NO_X$ catalyst device to an $SO_X$ releasable temperature when an $SO_X$ amount which is stored in the $NO_X$ catalyst device exceeds a predetermined allowable amount and which makes the air-fuel ratio of the exhaust gas which flows into the $NO_X$ catalyst device a stoichiometric air-fuel ratio or rich so as to make the stored $SO_X$ be released, an exhaust purification system of an internal combustion engine characterized in that the $NO_X$ catalyst device has a residual $SO_X$ storage amount which is dependent on the temperature of the $NO_X$ catalyst device when performing $SO_X$ release control and finally remains even if performing $SO_X$ release control, the system uses the residual $SO_X$ storage amount of the current $SO_X$ release control as the basis to calculate the $SO_X$ release speed at each timing in the current $SO_X$ release control, the system uses the $SO_X$ release speed which was calculated at each timing of the $SO_X$ release control as the basis to calculate a cumulative $SO_X$ release amount which is released from the start of $SO_X$ release control to the current timing and corrects the calculated $SO_X$ release speed at the current timing based on a ratio of a first radius and a second radius where when a releasable $SO_X$ amount obtained by subtracting from an $SO_X$ storage amount when starting $SO_X$ release control said residual $SO_X$ storage amount is deemed to correspond to an area of a circle of the first radius, a radius of a circle of an area corresponding to said cumulative $SO_X$ release amount is calculated as the second radius.

2. An exhaust purification system of an internal combustion engine which arranges in an engine exhaust passage an $NO_X$ catalyst device which stores $NO_X$ which is contained in exhaust gas when an air-fuel ratio of the inflowing exhaust gas is lean and which releases the stored $NO_X$ when the air-fuel ratio of the inflowing exhaust gas becomes a stoichiometric air-fuel ratio or rich and which uses $SO_X$ release control which raises a temperature of the $NO_X$ catalyst device to an $SO_X$ releasable temperature when an $SO_X$ amount which is stored in the $NO_X$ catalyst device exceeds a predetermined allowable amount and which makes the air-fuel ratio of the exhaust gas which flows into the $NO_X$ catalyst device a stoichiometric air-fuel ratio or rich so as to make the stored $SO_X$ be released, an exhaust purification system of an internal combustion engine characterized in that the $NO_X$ catalyst device has a residual $SO_X$ storage amount which is dependent on the temperature of the $NO_X$ catalyst device when performing $SO_X$ release control and finally remains even if performing $SO_X$ release control, the system uses the residual $SO_X$ storage amount of the current $SO_X$ release control as the basis to calculate the $SO_X$ release speed at each timing in the current $SO_X$ release control, characterized in that the $NO_X$ catalyst device has a final $NO_X$ storable amount at which $NO_X$ can be stored when said residual $SO_X$ storage amount remains, and the system uses the $SO_X$ release speed which was calculated at each timing of the $SO_X$ release control as the basis to calculate an $NO_X$ recovery amount which is restored from the start of $SO_X$ release control to the current timing and corrects the calculated $SO_X$ release speed at the current timing based on a ratio of a first radius and a second radius where when a restorable $NO_X$ storable amount obtained by subtracting from said final $NO_X$ storable amount an $NO_X$ storable amount when starting $SO_X$ release control is deemed to correspond to an area of a circle of the first radius, a radius of a circle of an area corresponding to said $NO_X$ recovery amount is calculated as the second radius.

3. An exhaust purification system of an internal combustion engine as set forth in claim 1, characterized in that the system uses the $SO_X$ release speed which was calculated at each timing of the $SO_X$ release control as the basis to calculate a cumulative $SO_X$ release amount which is released from the start of $SO_X$ release control to the current timing and corrects the calculated $SO_X$ release speed at the current timing based on a ratio of a first radius and a second radius where when a releasable $SO_X$ amount obtained by subtracting from an $SO_X$ storage amount when starting $SO_X$ release control said residual $SO_X$ storage amount is deemed to correspond to a volume of a sphere of the first radius, a radius of a sphere of a volume corresponding to said cumulative $SO_X$ release amount is calculated as the second radius.

4. An exhaust purification system of an internal combustion engine as set forth in claim 2, characterized in that the $NO_X$ catalyst device has a final $NO_X$ storable amount at which storage of $NO_X$ is possible when said residual $SO_X$ storage amount remains, and the system uses the $SO_X$ release speed which was calculated at the each timing of $SO_X$ release control as the basis to calculate an $NO_X$ recovery amount which is restored from the start of $SO_X$ release control to the current timing and corrects the calculated $SO_X$ release speed at the current timing based on a ratio of a first radius and a second radius where when a restorable $NO_X$ storable amount obtained by subtracting from said final $NO_X$ storable amount an $NO_X$ storable amount when starting $SO_X$ release control is deemed to correspond to a volume of a sphere of the first radius, a radius of a sphere of a volume corresponding to said $NO_X$ recovery amount is calculated as the second radius.

5. An exhaust purification system for an internal combustion engine, comprising:

an engine exhaust passage, an NOx catalyst device present in the engine exhaust passage, and an electronic control unit;

wherein the electronic control unit controls the NOx catalyst device and includes operable instructions:

(i) to store NOx present in an inflowing exhaust gas in the engine exhaust passage when an air-fuel ratio of the inflowing exhaust gas is lean, (ii) to release NOx stored in the NOx catalyst device when the air-fuel ratio of the inflowing exhaust gas is a stoichiometric air-fuel ratio or a rich air-fuel ratio, (iii) to release stored SOx in the NOx catalyst device, at a release speed, by raising the temperature of the NOx catalyst device to an SOx releasable temperature when an amount of the stored SOx present in the NOx catalyst device exceeds a predetermined allowable amount, (iv) to make the air-fuel ratio of the inflowing exhaust gas a stoichiometric air-fuel ratio or rich air-fuel ratio so as to release at least a portion of the amount of the stored SOx from the NOx catalyst device, and (v) to leave a residual amount of the stored SOx in the NOx catalyst device dependent on the temperature of the NOx catalyst device when releasing the stored, SOx and wherein the operable instruction (iii) to release the stored SOx calculates the release speed of the stored SOx based on a difference between a total amount of stored SOx in the NOx catalyst device and the residual amount of the stored SOx in the NOx catalyst device after releasing the stored SOx.

6. The exhaust purification system of claim 5, wherein the electronic control unit further includes operable instructions (vi) to control the release of the stored by calculating a cumulative amount of released SOx based on the release speed of the stored SOx and the time from a start of the release of the stored SOx, and (vii) to correct speed of release of the stored SOx based on a ratio of a first radius and a second radius wherein a releasable SOx amount is calculated by subtracting an amount of the stored SOx at a start of the release of the stored SOx and the residual amount of the stored SOx, and the residual amount of the stored SOx corresponds to an area of a circle of the first radius, and the a circle of an area of the circle of the second radius corresponds to said cumulative amount of the released SOx.

7. The exhaust purification system of claim 5, wherein the NOx catalyst device has a final NOx storable amount at which NOx can be stored and the residual amount of the stored SOx storage amount remains, and the electronic control unit further contains operable instructions (vii) to calculate a NOx recovery amount based on the speed of the release of the stored SOx calculated at release of the stored SOx and (viii) to calculate an NOx recovery amount which is restored from the start of the release of the stored SOx and (ix) to correct the calculated speed of the release of the stored SOx based on a ratio of a first radius and a second radius wherein an area of a first circle of the first radius corresponds to a restorable $NO_X$ storable amount obtained by subtracting from said final $NO_X$ storable amount an $NO_X$ storable amount when starting $SO_X$ release control, and an area of a second circle corresponds to second radius corresponding to said $NO_X$ recovery amount.

8. The exhaust purification system of claim 5, wherein the electronic control unit further includes operable instructions (x) to calculate a cumulative SOx release amount based on the speed of the release of the stored SOx wherein the cumulative SOx release amount is an amount of SOx is released from the start of the release of the stored SOx to the current timing and (xi) to correct the speed of the release of the stored SOx based on a ratio of a first radius and a second radius wherein a volume of a first sphere of the first radius corresponds to-a releasable SOx amount calculated by subtracting from an SOx storage amount when starting to release the stored SOx said residual SOx storage amount, and a volume of a second sphere of a second radius corresponds to said cumulative SOx release amount.

9. The exhaust purification system of claim 5, wherein the NOx catalyst device has a final NOx storable amount at which storage of NOx is possible when said residual amount of the stored SOx remains, and the electronic control unit further includes operable instructions (xii) to correct the speed of the release of the stored SOx calculated at the SOx release control as a basis to calculate an NOx recovery amount which is restored from the start of SOx release control and corrects the calculated SOx release speed at the current timing based on a ratio of a first radius and a second radius wherein a first volume of a first sphere of the first radius corresponds to a restorable NOx storable amount obtained by subtracting from said final NOx storable amount an NOx storable amount when starting SOx release control, and a second volume of a second radius of a second sphere corresponds to said calculated NOx recovery amount.

* * * * *